US010065769B2

(12) United States Patent
Ezaki et al.

(10) Patent No.: US 10,065,769 B2
(45) Date of Patent: Sep. 4, 2018

(54) EASY-OPEN PACKAGING POUCH AND METHOD FOR OPENING SAME

(75) Inventors: Hirofumi Ezaki, Ehime (JP); Akihisa Higashihara, Ehime (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 988 days.

(21) Appl. No.: 14/236,633

(22) PCT Filed: Aug. 2, 2012

(86) PCT No.: PCT/JP2012/004929
§ 371 (c)(1),
(2), (4) Date: Feb. 3, 2014

(87) PCT Pub. No.: WO2013/018370
PCT Pub. Date: Feb. 7, 2013

(65) Prior Publication Data

US 2014/0174042 A1 Jun. 26, 2014

(30) Foreign Application Priority Data

Aug. 4, 2011 (JP) ..... 2011-171385

(51) Int. Cl.
*B65D 33/00* (2006.01)
*B65D 33/16* (2006.01)
*B65D 75/58* (2006.01)

(52) U.S. Cl.
CPC ..... *B65D 33/16* (2013.01); *B65D 75/5816* (2013.01)

(58) Field of Classification Search
CPC ..... B65D 33/16; B65D 75/5816
(Continued)

(56) References Cited

U.S. PATENT DOCUMENTS 3,342,326 A * 9/1967 Zackheim ..... A61J 1/067 206/438
3,724,651 A * 4/1973 Link ..... B65D 75/5855 206/363

(Continued)

FOREIGN PATENT DOCUMENTS

JP H11-278501 A 10/1999
JP 2005-200050 A 7/2005

(Continued)

OTHER PUBLICATIONS

International Search Report of PCT Application No. PCT/JP2012/004929.

(Continued)

*Primary Examiner* — Ernesto Grano
(74) *Attorney, Agent, or Firm* — Wenderoth, Lind & Ponack, L.L.P.

(57) ABSTRACT

An easy open packaging pouch, including a packaging film, with a bonded peripheral edge section that has been formed by superimposing the packaging film such that two bonding layers are facing one another such that the peripheral edge of the packaging film is bonded. The package is designed to tear open from a notch formed in the peripheral edge, and a content is placed such that a tear starting from the starting point will intersect the content during opening. Opening includes tearing along a tear line that advances diagonally, with respect to the content, from the notch. Once the tear reaches the content, the tear diverges in two directions; one continuing in a substantially unchanged direction, and the other inflecting along the content. Opening will expose an end portion of the content.

21 Claims, 16 Drawing Sheets

(58) Field of Classification Search
USPC ..... 206/484
See application file for complete search history.

(56) References Cited

U.S. PATENT DOCUMENTS

| | | | | |
|---|---|---|---|---|
| 3,809,228 | A * | 5/1974 | Fowler | B65D 75/5805 206/306 |
| 4,136,776 | A * | 1/1979 | Poncy | B65D 75/26 206/306 |
| 4,630,729 | A * | 12/1986 | Hirt | B65D 75/30 156/291 |
| 4,720,011 | A * | 1/1988 | Canamero | B65D 75/5805 206/455 |
| 4,871,091 | A * | 10/1989 | Preziosi | A61F 9/0008 206/438 |
| 4,881,644 | A * | 11/1989 | Norquest | A61F 13/55185 206/363 |
| 6,296,389 | B1 | 10/2001 | Yamamoto et al. | |
| 8,302,844 | B2 | 11/2012 | McConnell et al. | |
| 8,307,983 | B2 * | 11/2012 | Ludwig | B65D 75/30 206/484 |
| 8,317,765 | B2 | 11/2012 | Loyd et al. | |
| 8,794,837 | B2 * | 8/2014 | Hanus | B32B 7/045 383/200 |
| 9,120,609 | B2 * | 9/2015 | De Soto-Burt | A61F 13/551 |
| 9,370,463 | B2 * | 6/2016 | Krumme | B65D 75/5833 |
| 9,538,827 | B2 * | 1/2017 | Burton | A45D 40/26 |
| D782,325 | S * | 3/2017 | Gray | D9/707 |
| 9,637,293 | B2 * | 5/2017 | Krumme | B65D 75/5833 |
| 2002/0136470 | A1 * | 9/2002 | Richardson | B65D 75/566 383/200 |
| 2002/0172834 | A1 * | 11/2002 | Rivett | B32B 27/08 428/515 |
| 2003/0089625 | A1 * | 5/2003 | Moodie | B65D 75/585 206/204 |
| 2003/0152300 | A1 * | 8/2003 | Tu | B65D 75/5811 383/207 |
| 2006/0226043 | A1 * | 10/2006 | Smith | A61J 1/067 206/438 |
| 2007/0156109 | A1 | 7/2007 | Loyd et al. | |
| 2007/0205127 | A1 * | 9/2007 | Barndt | A61J 1/00 206/484 |
| 2008/0118679 | A1 | 5/2008 | McConnell et al. | |
| 2013/0053810 | A1 | 2/2013 | Loyd et al. | |

FOREIGN PATENT DOCUMENTS

| | | | |
|---|---|---|---|
| JP | 2010-509978 | A | 4/2010 |
| WO | WO-2007-075217 | A1 | 7/2007 |
| WO | WO-2008-062362 | A1 | 5/2008 |

OTHER PUBLICATIONS

"Precision Xtra, Blood Glucose & Ketone Monitoring System, User's Manual", 2008, p. 17, Abbot Diabetes Care Inc., Alameda, CA 94502 USA.

Office Action from the corresponding Japanese Patent Application No. 2013-526761 dated Jan. 27, 2015.

* cited by examiner

FIG. 14
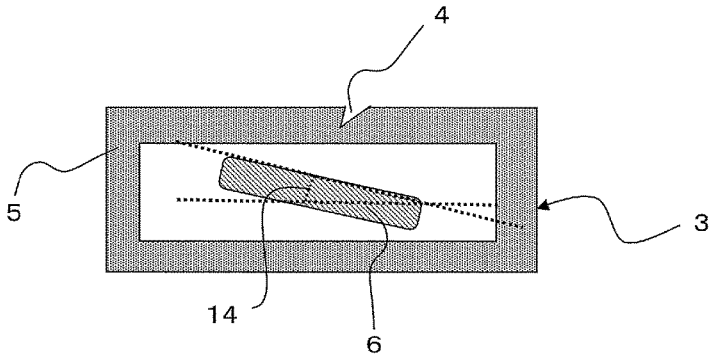
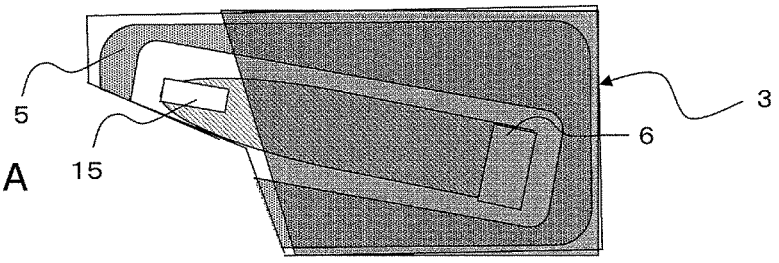
FIG. 15A
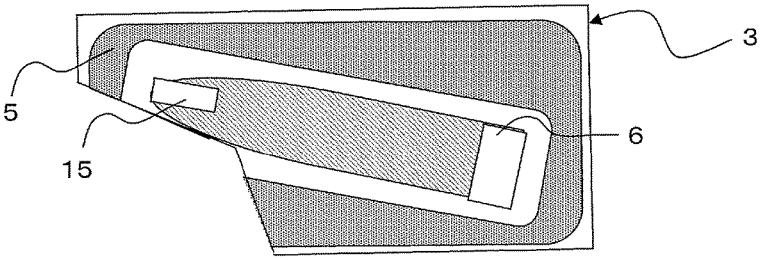
FIG. 15B

EASY-OPEN PACKAGING POUCH AND METHOD FOR OPENING SAME

PRIORITY

This application claims priority to Japanese Patent Application No. 2011-171385 filed on Aug. 4, 2011 and PCT application PCT/JP2012/004929 filed on Aug. 2, 2012. The entire disclosures of Japanese Patent Application No. 2011-171385 and PCT application PCT/JP2012/004929 are hereby incorporated herein by reference.

TECHNICAL FIELD

The present invention relates to an easy-open packaging pouch that can be opened easily by tearing open a bonded section, from a notch or from a design pattern indicating a tear start point.

BACKGROUND

To date, easy-open packing pouches of various types have been developed for use as hermetic pouches to package products in a wide variety of fields, such as food and beverages, industrial products, medical products, and the like, because such pouches can simply be thermally fused, obviating the need for sealing with adhesives and the like.

In the medical field, easy-open packing pouches have been employed for packaging of flat elongated products such as electrodes for measuring blood glucose level and the like. In consideration of consumers purchasing a product that has been packed into this type of sealed pouch, there have been proposed structures whereby the sealed pouch can be opened safely and easily without the use of an implement such as a scissors, kitchen knife, or blade (for example, Precision Xtra G3b electrode (made by Abbott Laboratories), Japanese Laid-Open Patent Application 11-278501).

For example, as shown in FIG. 23, Precision Xtra G3b electrode (made by Abbott Laboratories) discloses a plan view of a packaging film 100 for a sensor 104 for measuring blood glucose level, made by Abbott Laboratories.

This packaging bag, which has a heat-bonded peripheral edge section 101 formed along its four sides in order to package a flat elongated product such as an electrode for measuring blood glucose level, is configured such that the packaging pouch can be torn open from a notch 102 pre-provided in a lengthwise direction of the pouch, and the content is taken out. When a packaging pouch of the afore described configuration is opened to take out the content for use, the pouch begins to tear from the notch 102, which functions as an origination point of the tear line. An aperture is then created in the packaging pouch, through tearing of the heat-bonded peripheral edge section 101, followed by tearing of the packaging section 103. Packaging pouches in which a notch or the like is disposed at an edge of the pouch to enable opening by hand are utilized as a packaging format for many products.

As shown in FIG. 24, Japanese Laid-Open Patent Application 11-278501 discloses a plan view of an easy-open packaging pouch 111 formed by a packaging film 105 for sensor for measuring blood glucose level.

In this easy-open packaging pouch 111, two pieces of packaging film 106 of tetragonal shape each including a base material layer and a thermoplastic resin layer are superimposed, and, leaving a non-heat-bonded section 107 in a prescribed area at one side, a heat-bonded peripheral edge section 108 is formed in three-sided square pattern along the other three sides. Additionally, there is formed a protruding heat-bonded section 109 that connects both ends of the heat-bonded peripheral edge section 108 and that protrudes outward. At least the protruding heat-bonded section 109 is sealed in separable fashion, and a cutout section 110 is formed at a location adjacent to an end of the heat-bonded peripheral edge section along at least one edge of the packaging film on the front surface side.

When opening the packaging pouch of this configuration to take out the electrode sensor 112 for measuring blood glucose level contained therein, firstly, the packing film of the non-heat-bonded section 107 is grasped with the fingers and pulled to either side, separating the protruding heat-bonded section 109 from the distal end to bring about separation as far as an opening line 113. The separated packing films 105, 106 are then respectively folded outward to expose an end section 114 of the electrode sensor 112 for measuring blood glucose level from the packaging pouch. In so doing, this exposed end section 114 can be grasped with the fingers to remove the electrode sensor 112 for measuring blood glucose level.

Thereafter, blood is impregnated through a specimen delivery path (cavity) constituted by the exposed section of the taken out electrode sensor 112 for measuring blood glucose level, and the blood glucose level is measured.

SUMMARY

However, the configurations disclosed in the aforementioned Japanese Laid-Open Patent Application 11-278501 and Precision Xtra G3b electrode (made by Abbott Laboratories) have problems such as the following, in terms of being able to easily and safely take out the content during opening, which problems made the configurations not fully satisfactory for the consumer.

For example, while the configuration disclosed in Precision Xtra G3b electrode (made by Abbott Laboratories) has the advantage that the packaging pouch provided with the notch 102 shown in FIG. 23 is easily pulled apart during opening, the tear line sometimes snags on the content midway through the opening process, making opening difficult. A further problem is that when greater force is exerted to pull apart the pouch, the content can become bent or otherwise damaged, or the content may fall out and drop from the packaging pouch. Additionally, when care is taken to skirt around content during opening so as to avoid the tear line coming into contact with the content, there are cases in which the end section of the content is not exposed from within the packaging pouch after opening, creating an inconvenience in that taking out the content (an electrode sensor for measuring blood glucose level or the like) is difficult.

With the configuration disclosed in Japanese Laid-Open Patent Application 11-278501, when opening the packaging pouch, which has been configured such that the packaging film 105 of the non-heat-bonded section 107 shown in FIG. 24 is grasped with the finger and pulled to either side, strong force is needed to separate the protruding heat-bonded section 109 in its entirety from the distal end. Furthermore, when excessive force is applied during opening, there is a risk of separation of the entire packaging pouch, so that the electrode sensor 112 for measuring blood glucose level becomes damaged due the impact of falling from the packaging pouch, or becomes contaminated, and is no longer useable. There is a drawback that opening is difficult for the elderly who have frequent occasion to use electrode sensors 112 for measuring blood glucose level.

An object of the present invention is to provide an easy-open packaging pouch by which, through adoption of a design for a packaging pouch that is opened by being pulled apart from previously provided notch or a design pattern indicating a tear start point, the opening force may be reduced during opening, so that an end section of the content can be easily exposed, without the need to take care to avoid snagging on the contents. Moreover, damage to or falling of the contents can be reliably prevented, whereby the present easy-open packaging pouch affords exceptional safety in cases in which contents that require care in handling are being taken out.

To achieve the afore described object, the easy-open packaging pouch according to a first aspect of the present invention is pouch for wrapping a content of substantially rectangular shape, provided with packaging film, a bonded peripheral edge section, a tear start point, and a content. The packaging film has a base material layer and a bonding layer. The bonded peripheral edge section is formed by superimposing the packaging films in such a way that the bonding layer surfaces face one another, and bonding the peripheral edges together. The tear start point is formed in the bonded peripheral edge section. The contents are arranged on the diagonal with respect to a direction in which tearing advances from the tear start point.

The easy-open packaging pouch according to a second aspect of the present invention resides in the easy-open packaging pouch according to the first aspect of the present invention, wherein the tear start point is a notch indicating the tear start point.

The easy-open packaging pouch according to a third aspect of the present invention resides in the easy-open packaging pouch according to the first aspect of the present invention, wherein the tear start point is a design pattern indicating the tear start point. The design pattern may be any design selected, for example, from pictorial illustrations, patterns, decorative elements, graphics, points, lines, alphabetic characters, numeric characters, symbols, and combinations thereof.

The easy-open packaging pouch according to a fourth aspect of the present invention resides in the easy-open packaging pouch according to the second or third aspect of the present invention, wherein the content is arranged at an angle of 5° to 85° with respect to the direction in which tearing advances from the tear start point.

The easy-open packaging pouch according to a fifth aspect of the present invention resides in the easy-open packaging pouch according to the first aspect of the present invention, wherein the area of the bonded peripheral edge section in which the tear start point has been formed protrudes in the direction of the contents.

The easy-open packaging pouch according to a sixth aspect of the present invention resides in the easy-open packaging pouch according to the second aspect of the present invention, wherein the notch has a simple cutout shape, or a shape that narrows at the distal end towards the direction in which tearing advances from the notch.

The easy-open packaging pouch according to a seventh aspect of the present invention resides in the easy-open packaging pouch according to the first aspect of the present invention, wherein the bonded peripheral edge section is formed in an outside edge section of the packaging film.

The easy-open packaging pouch according to an eighth aspect of the present invention resides in the easy-open packaging pouch according to the first aspect of the present invention, wherein at least a part of the bonded peripheral edge section is formed in the inside from an outside edge section of the packaging film, and the tear start point is formed in an outside edge section of the packaging film.

The easy-open packaging pouch according to a ninth aspect of the present invention resides in the easy-open packaging pouch according to the first aspect of the present invention, wherein the bonded peripheral edge section is formed at peripheral edges except for one side produced by folding of a single packaging film.

The easy-open packaging pouch according to a tenth aspect of the present invention resides in the easy-open packaging pouch according to the first aspect of the present invention, wherein the packaging film is constituted by at least two superimposed packaging films.

The easy-open packaging pouch according to an eleventh aspect of the present invention resides in the easy-open packaging pouch according to the first aspect of the present invention, wherein a rupture line leading the direction, in which tearing advances from the tear start point, to the content during opening is formed on the packaging film, the contact angle of the rupture line and the content being from 5° to 85°.

The easy-open packaging pouch according to a twelfth aspect of the present invention resides in the easy-open packaging pouch according to the first aspect of the present invention, wherein an area surrounding the contents in the packaging film has a blister structure.

The easy-open packaging pouch according to a thirteenth aspect of the present invention resides in the easy-open packaging pouch according to the first aspect of the present invention, wherein the bonded peripheral edge section includes a thermoplastic resin layer.

The easy-open packaging pouch according to a fourteenth aspect of the present invention resides in the easy-open packaging pouch according to the first aspect of the present invention, wherein at least the packaging film or the bonded peripheral edge section is substantially tetragonal in shape.

The easy-open packaging pouch according to a fifteenth aspect of the present invention resides in the easy-open packaging pouch according to the first aspect of the present invention, wherein one of the packaging films is thinner than the superimposed other packaging film.

The easy-open packaging pouch according to a sixteenth aspect of the present invention resides in the easy-open packaging pouch according to the fifteenth aspect of the present invention, wherein the packaging film on the side at which the tear line advances while inflecting along a contour line of the content is thinner than the packaging film on the side at which the tear line advances in unchanging fashion.

The easy-open packaging pouch according to a seventeenth aspect of the present invention resides in the easy-open packaging pouch according to the first aspect of the present invention, wherein once the tear line contact the contents or reaches the vicinity thereof during opening from the tear start point on the packaging film, the tear line diverges in two, a first tear line advancing in unchanging fashion, and a second tear line advancing while inflecting along the contents.

The easy-open packaging pouch according to an eighteenth aspect of the present invention resides in the easy-open packaging pouch according to the seventeenth aspect of the present invention, wherein the location of the tear start point is formed in an outside edge section of the packaging film, between the top end and the bottom end of a side in the lengthwise direction of the content.

The easy-open packaging pouch according to a nineteenth aspect of the present invention resides in the easy-open packaging pouch according to the first aspect of the present invention, wherein the content is arranged at an angle of 5° to 85° with respect to the lengthwise direction of the packaging film.

The easy-open packaging pouch according to a twentieth aspect of the present invention resides in the easy-open packaging pouch according to the seventeenth aspect of the present invention, wherein the content is a biosensor for measuring a sample component.

The easy-open packaging pouch according to a twenty-first aspect of the present invention resides in the easy-open packaging pouch according to the twentieth aspect of the present invention, wherein the biosensor is arranged on the packaging film such that a sample application section side of the biosensor is exposed towards the side from which opening proceeds from the tear start point.

The easy-open packaging pouch according to a twenty-second aspect of the present invention resides in the easy-open packaging pouch according to the twentieth aspect of the present invention, further provided with a drying area section disposed in the packaging film, and adapted for retaining a desiccant to eliminate moisture from the biosensor.

The method for opening an easy-open packaging pouch according to a twenty-third aspect of the present invention resides in a method for opening an easy-open packaging pouch in which the content inside a packaging pouch, which is obtained by superimposing a packaging film having a base material layer and a bonding layer such that the bonding layer surfaces thereof face one another, bonding peripheral edges of the packaging film together to form a bonded peripheral edge section, and forming at least one notch, or a design pattern indicating a tear start point, in the bonded peripheral edge section is taken out by opening the packaging pouch through pulling apart from an origination point constituted by the notch or the design pattern indicating a tear start point. The present method for opening includes a step in which a tear line advances diagonally with respect to the content from an origination point constituted by the notch or design pattern indicating a tear start point; a step in which the tear line, upon contacting the content or reaching the vicinity thereof, diverges into two tear lines, a first tear line continuing to advance in unchanging fashion, and a second tear line advancing while inflecting along the contents; and a step in which an end section of the content is exposed.

According to the present invention, once a tear line contacts the contents or reaches the vicinity thereof during opening, the tear line diverges in two, with a first tear line continuing to advance in the same manner as the direction of advance of the tear, and a second tear line advancing while inflecting along the contents, whereby opening is possible without the tear line becoming caught on the contents during opening. As a result, the contents do not suffer damage (bending, scratches), and the contents can be prevented from falling out from the packaging pouch, even when opened vigorously. Moreover, a high degree of force is not required during opening, whereby even the elderly, who have frequent occasion to use contents requiring care in handling, for example, electrode sensors for measuring blood glucose level, are able to open the pouch easily, whereupon an end section of the contents becomes exposed from the packaging pouch as a matter of course after opening, making it easy for the content to be taken out.

BRIEF DESCRIPTION OF THE DRAWINGS

FIG. 14 is a cross sectional plan view showing the easy-open packaging pouch of the present invention prior to opening.

FIG. 15A is a plan view showing the easy-open packaging pouch of the present invention after opening, and FIG. 15B is a plan view in which the packaging film on the closer side in FIG. 15A has been removed.

DETAILED DESCRIPTION OF THE INVENTION

The easy-open packaging pouch according to an embodiment of the present invention shall be described below on the basis of the drawings.

In the present embodiment, a case in which a blood glucose level measurement sensor (biosensor) 6 for measuring glucose concentration in blood as an analyte shall be described as an example of the content of the easy-open packaging pouch. FIGS. 1 to 22 depict merely one embodiment of the present invention; the embodiments not being limited thereto.

(First Embodiment)

Figure 1A:
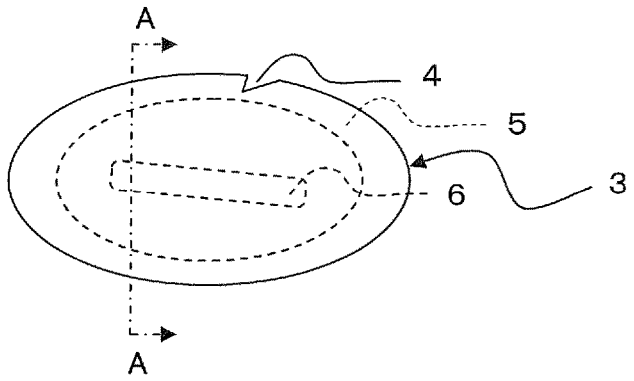
FIG. 1A is a plan view showing the easy-open packaging pouch of the present invention prior to opening.
Figure 1B:
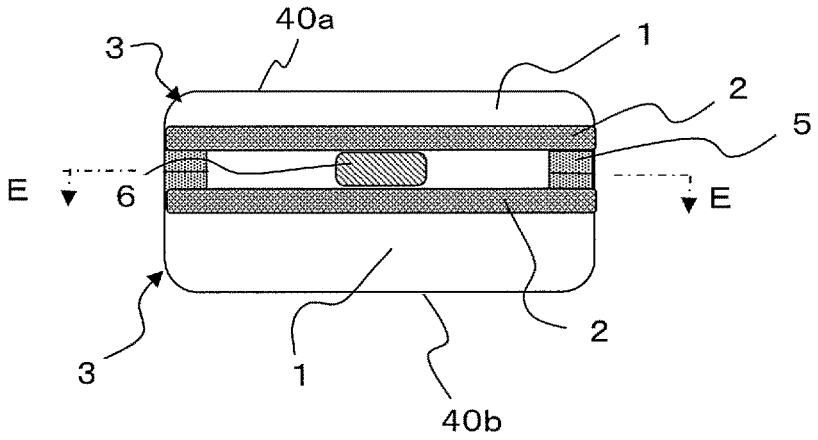
FIG. 1B is a cross sectional side view showing the easy-open packaging pouch of the present invention prior to opening.
Figure 1C:
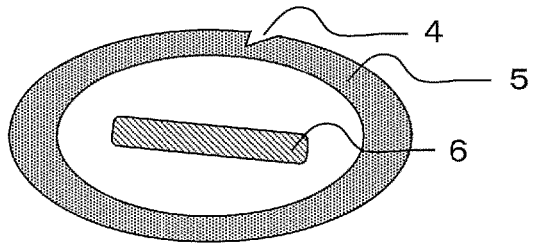
FIG. 1C is a cross sectional plan view showing the easy-open packaging pouch of the present invention prior to opening.

FIG. 1A, FIG. 1B, and FIG. 1C are respectively a plan view, a cross sectional side view, and a cross sectional plan view showing the easy-open packaging pouch according to a first embodiment of the present invention prior to opening. FIG. 1B shows an enlarged view of a cross section taken at location A-A shown in FIG. 1A. FIG. 1C is a view showing a cross section of the easy-open packaging pouch taken at location E-E shown in FIG. 1B.

The easy-open packaging pouch of the present embodiment is a packaging pouch formed by superimposing the bonding layers of packaging films 3 that include a base material layer 1 and a bonding layer 2, and is employed to wrap a blood glucose level measurement sensor (contents, biosensor) 6 of substantially rectangular shape. A bonded peripheral edge section 5 is formed along the peripheral edge of the packaging films 3. At least one notch 4, or a design pattern indicating a tear start point, is formed in the bonded peripheral edge section 5.

The packaging films 3 surfaces and the bonded peripheral edge section 5 cover the blood glucose level measurement sensor 6, whereby the blood glucose level measurement sensor 6 is isolated from the outside air and completely hermetically sealed, and therefore does not become contaminated by dust or dirt, which is outstanding from the standpoint of the storage stability of the blood glucose level measurement sensor 6.

Figure 2:
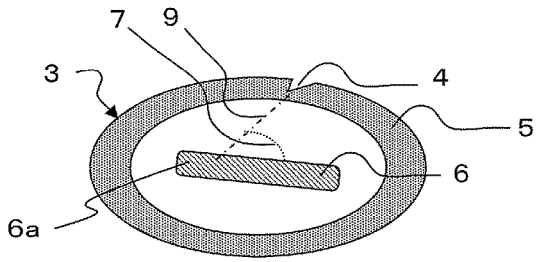
FIG. 2 is a cross sectional plan view showing the easy-open packaging pouch of the present invention prior to opening.

As shown in FIG. 2, the blood glucose level measurement sensor 6 is arranged on the diagonal with respect to the direction in which tearing advances 9 (see the dashed line) from the notch 4 or from the design pattern indicating the tear start point. With regard to adjustment of the direction of the blood glucose level measurement sensor 6, the blood glucose level measurement sensor 6 may be arranged on the diagonal with respect to the direction in which tearing advances 9 from the notch 4 or from the design pattern indicating the tear start point, through adjustment of the cutting angle of the notch and/or of the design pattern of the tear start point.

The design pattern may be any design pattern indicating the tear start point, and any desired design selected from pictorial illustrations, patterns, decorative elements, graphics, points, lines, characters, numeric characters, symbols, and combinations thereof, can be employed as appropriate.

Figure 17:
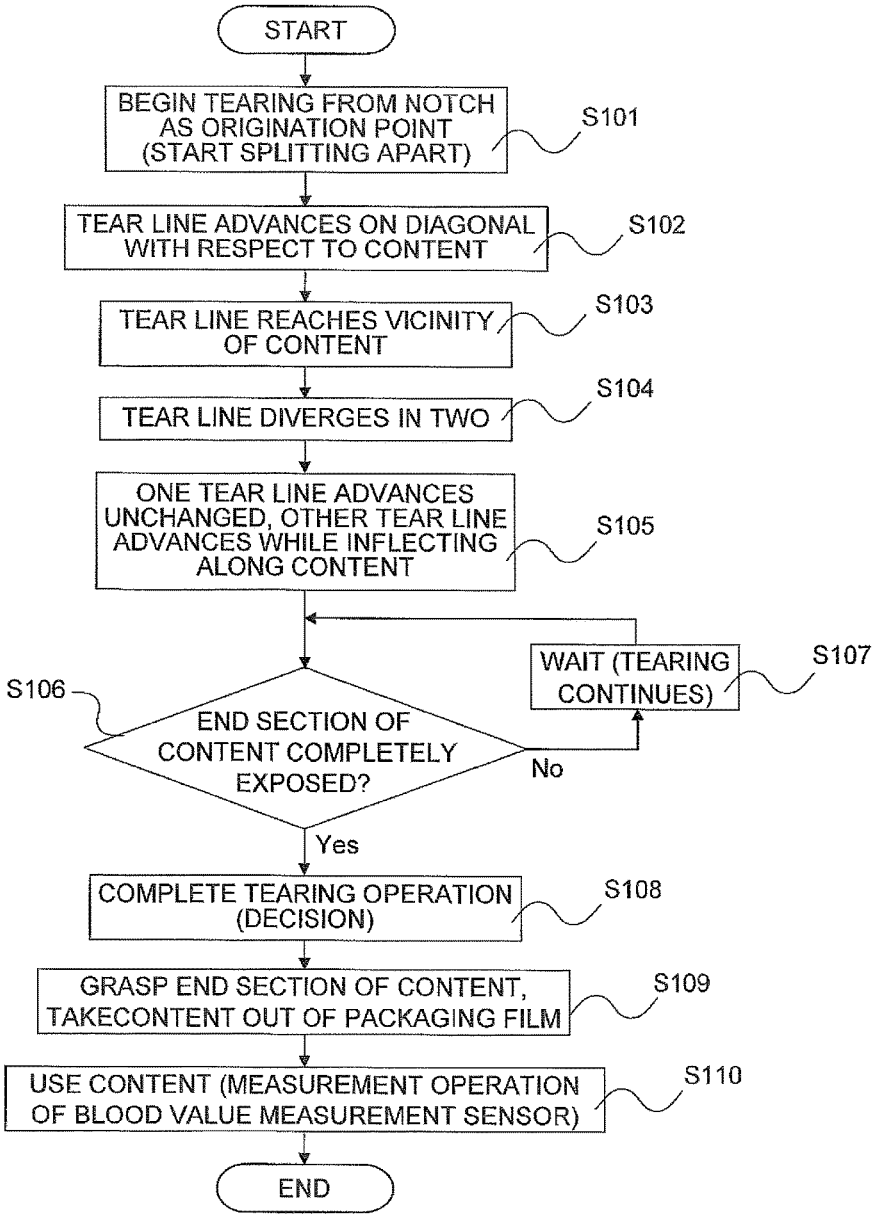
FIG. 17 is a flowchart showing the procedure when opening the easy-open packaging pouch of the present invention.

Next, the method for opening the easy-open packaging pouch of the first embodiment shall be described, employing FIGS. 1, 2, 17, and 18. FIG. 1A and FIG. 1B are respectively a plan view and a cross sectional view showing the present easy-open packaging pouch prior to opening. FIG. 2 is an arrangement diagram showing the respective positional relationships of the notch 4 or the design pattern indicating the tear start point, the blood glucose level measurement sensor 6, and the direction in which tearing advances 9. FIG. 17 is a flowchart showing the procedure in a case in which the blood glucose level measurement sensor 6 shown in FIG. 1, which has been wrapped inside the easy-open packaging pouch of the first embodiment, is opened towards the direction in which tearing advances 9. FIG. 18A to FIG. 18D are plan views describing the easy-open packaging pouch of the present invention when open. FIG. 18A to FIG. 18D are views seen from the bottom surface 40*b* side shown in FIG. 1.

Figure 18A:
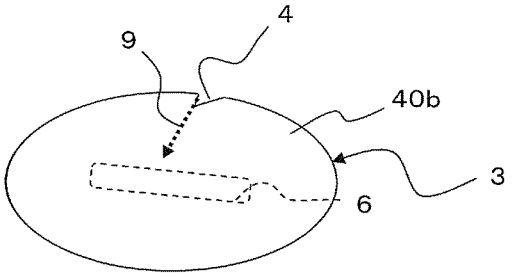
FIG. 18A to FIG. 18D are plan views showing the easy-open packaging pouch of the present invention when open.

When the present easy-open packaging pouch is opened, firstly both sides of the pre-provided notch 4 or design pattern indicating the tear start point are grasped between the fingers to, each side is pulled in respectively different directions, by which the easy-open packing pouch initiates to be torn with the notch 4 or the design pattern indicating the tear start point as the origination point (S101 in FIG. 17 and FIG. 18A).

The tear line advances along the direction of the cutting angle of the notch 4 and/or the angle of the design pattern indicating the tear start point (S 102 in FIG. 17). The tear line eventually reaches the vicinity of the blood glucose level measurement sensor 6 (blood glucose level measurement sensor) in due course (S 103 in FIG. 17 and FIG. 18B).

Figure 18B:
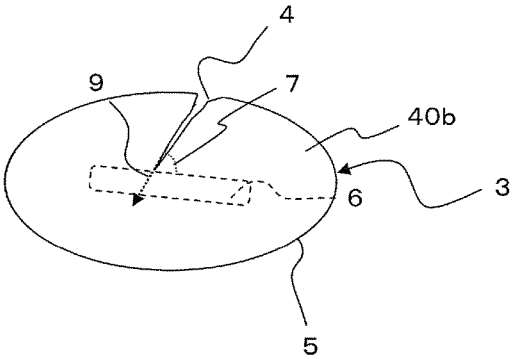
Figure 18C:
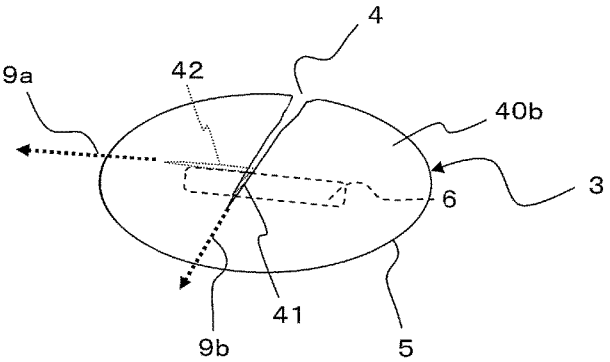
Figure 18D:
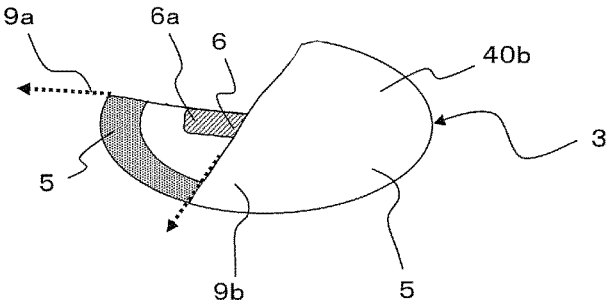

At this time, because the tear line contacts the blood glucose level measurement sensor 6 (blood glucose level measurement sensor) aslant at a prescribed angle 7, the tear line begins to diverge in two (S 104, FIG. 18B, and FIG. 18C).

This happens because, whereas the tear line in one of the packaging films continues to advance in unchanging fashion without obstruction, the other tear line is obstructed by the blood glucose level measurement sensor 6 and therefore can no longer advance straight forward, instead advancing on an inflected path along a contour line of the blood glucose level measurement sensor 6 (S105). At this time, the two tear lines diverge, while the prescribed angle 7 between the direction in which tearing advances 9 and the contour line of the blood glucose level measurement sensor 6 is maintained. In FIG. 18C, 41 indicates the one tear line that continues to advance in unchanging fashion, and 9*b* indicates the direction of advance of the one tear line 41. 42 indicates the other tear line that advances on an inflected path, and 9*a* indicates the direction of advance of the other tear line 42. The one tear line 41 is formed in the packaging film 3 on the side of the bottom surface 40*b* in FIG. 1, and the other tear line 42 is formed in the packaging film 3 on the side of the top surface 40*a* in FIG. 1. As will be described in greater detail below, this is because the thinner one tears more easily, facilitating advance on an inflected path along the blood glucose level measurement sensor 6.

As the easy-open packaging pouch proceeds to tear, the end section of the content, i.e., the blood glucose level measurement sensor 6, gradually begins to appear at a location in the space between the two divergent tear lines. Tearing proceeds further until the end section 6*a* of the blood glucose level measurement sensor 6 is completely exposed (S106, S107 in FIG. 17, and FIG. 18D).

Once the end section of the blood glucose level measurement sensor 6 is completely exposed, the tearing operation is completed (S108).

Thereafter, the blood glucose level measurement sensor 6 is grasped from the end, and the blood glucose level measurement sensor 6 is taken out from the packaging film (S109).

Thereafter, the blood glucose level measurement sensor 6 is used for its prescribed purpose (S110).

Next, in accordance with the flowchart showing the opening procedure in FIG. 17, there were performed actual tests in which easy-open packaging pouches in which blood glucose level measurement sensors 6 were wrapped were opened by hand.

The material for the easy-open packaging pouches employed in the tests was a composed of the four layers PET1/AL/PET2/PE. It was possible to form the packaging pouch by superimposing the innermost layers, i.e., the PE side, and thermally bonding these at 100 to 150° C. Specifically, the innermost PE layers correspond to the bonding layers 2. The bonded peripheral edge section 5 is formed through thermal bonding of the PE layers.

Table 1 represents the extent to which the tear lines affect the contents (the blood glucose level measurement sensor 6) during opening, when the angle 7 of contact of the blood glucose level measurement sensor 6 and the direction in which tearing advances 9 from the pre-provided notch 4 or from a design pattern indicating the tear start point is varied, through adjustment of the angle of the contents (the blood glucose level measurement sensor 6) wrapped in the easy-open packaging pouch.

In specific terms, as samples, a total of 45 easy-open packaging pouches, namely, five each of pouches in which the angle 7 of contact of the blood glucose level measurement sensor 6 and the direction in which tearing advances 9 from the notch 4, or from the design pattern indicating the tear start point, was adjusted within a range of 0° and 90°, specifically, to 90°, 85°, 80°, 65°, 45°, 25°, 10°, 5°, and 0°, were prepared, and were opened in succession using the fingertips.

The blood glucose level measurement sensor 6 wrapped in the easy-open packaging pouch shall be described here.

Figure 19A:
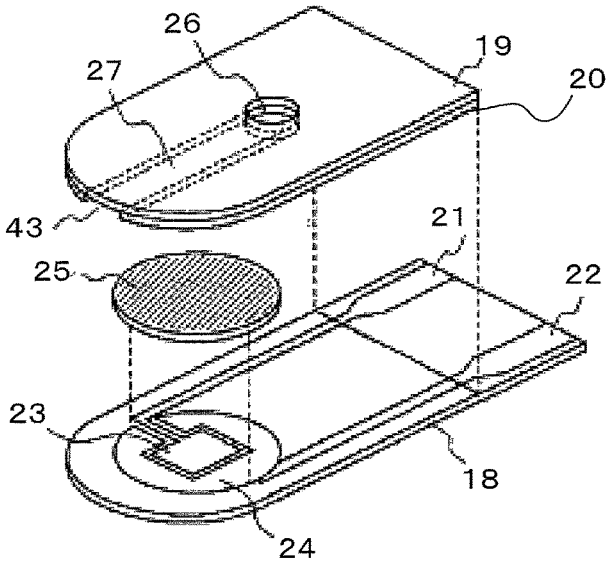
FIG. 19A is an exploded perspective view showing the configuration of the content (blood glucose level measurement sensor) of the easy-open packaging pouch of the present invention.

As shown in FIG. 19A, the blood glucose level measurement sensor 6 is manufactured by stacking an insulating substrate 18, a spacer 20, and a cover 19 in that order and unifying them through adhesive bonding, thermal bonding, or the like.

Figure 19B:
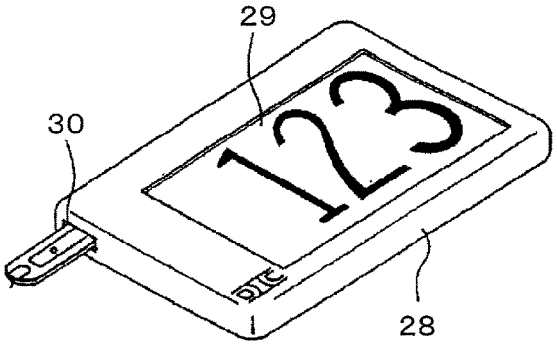
FIG. 19B is a perspective view showing use of the blood glucose sensor shown in FIG. 19A to measure blood glucose levels.

Typically, as shown in FIG. 19B, in a state in which the blood glucose level measurement sensor 6 has been installed into a card-shaped measuring instrument 28 through insertion from the terminal 21, 22 side thereof into a test piece installation section 30 of the measuring instrument 28, a biological specimen, for example, blood or the like, is applied onto the end section of the blood glucose level measurement sensor 6. The applied blood is drawn by capillary action through an inlet port 43 into a cavity 27 formed in the spacer 20, and reaches the reagent 25 which has been applied to a measuring electrode 23 and a counter electrode 24. Here, to bring about an enzyme reaction of the blood with the reagent, voltage is applied by the measuring instrument 28 to the terminals 21, 22 of the blood glucose level measurement sensor 6, thereby oxidizing the reaction product in the enzyme reaction, and the oxidation current generated at that time is measured by the measuring instrument 28. In so doing, on the basis of the measured oxidation current, the concentration of the measured component is converted to blood glucose level.

A reagent containing glucose oxidase as the enzyme is employed as the reagent when measuring glucose in a measured solution. A display section 29 for displaying the measurement results is arranged on a surface of the measuring instrument 28. The test piece installation section 30 of the measuring instrument 28 is provided with positive and negative electrodes (not shown) for respective electrical connection to the terminals 21, 22 of the blood glucose level measurement sensor 6 when the blood glucose level measurement sensor 6 is installed therein. 26 is a hole for air to escape.

The testing procedure and results shall be described below.

Firstly, in the conventional packaging pouch, in which the angle 7 at which the direction in which tearing advances 9 contacts the blood glucose level measurement sensor 6 was 90°, the tear line inevitably contacted the blood glucose level measurement sensor 6 upon reaching the vicinity of contact with the blood glucose level measurement sensor 6. At this time, the tear line, obstructed by the blood glucose level measurement sensor 6, came to a stop, so tearing could no longer proceed, making opening difficult. Therefore, conventionally, the easy-open packaging pouch was opened by reorienting the tearing direction by 90° through deliberate shifting of the bag to a greater or lesser extent, so that the tear line does not come into contact with the blood glucose level measurement sensor 6.

However, in such cases, midway through the tearing process, the tear line sometimes snagged on the blood glucose level measurement sensor 6 so that opening proceeds with difficulty, or even when opening was successful, the tear line did not diverge in two, as shown in S104 of FIG. 17 and in FIG. 18C. As a result, the end section of the contents, i.e., the blood glucose level measurement sensor 6, were not exposed from the packaging pouch, thus making it difficult to take out the blood glucose level measurement sensor 6.

Furthermore, when even greater force was exerted during opening to pull apart the pouch vigorously, the tear line sometimes contacted the blood glucose level measurement sensor 6, producing damage such as bending of the blood glucose level measurement sensor 6, or causing the blood glucose level measurement sensor 6 to fall out and drop from the packaging pouch, or producing other such problems, so that good results were not obtained. Similar phenomena were observed for all five samples, and those with undesirable results are shown by the "x" symbol in Table 1.

TABLE 1

| Angle | Result 1 | Result 2 | Result 3 | Result 4 | Result 5 | Evaluation |
|---|---|---|---|---|---|---|
| 90° | X | X | X | X | X | X |
| 85° | Δ | Δ | Δ | Δ | Δ | Δ |
| 80° | ○ | ○ | Δ | ○ | ○ | Δ |
| 65° | ◎ | ◎ | ◎ | ◎ | ◎ | ◎ |
| 45° | ◎ | ◎ | ◎ | ◎ | ◎ | ◎ |
| 25° | ◎ | ◎ | ◎ | ◎ | ◎ | ◎ |
| 10° | Δ | ○ | ○ | Δ | ○ | Δ |
| 5° | Δ | Δ | Δ | Δ | Δ | Δ |
| 0° | X | X | X | X | X | X |

Next, in the case in which the angle 7 of contact of the direction in which tearing advances 9 and the blood glucose level measurement sensor 6 was 85°, the tear line inevitably contacted the blood glucose level measurement sensor 6 upon reaching the vicinity of contact with the blood glucose level measurement sensor 6. At this time, the tear line, obstructed by the blood glucose level measurement sensor 6, initially came to a stop at that point, but with the application of further force, was possible to cause the tear line to diverge in two directions so that tearing could proceed.

However, in some cases the result was that the problem that damage, such as bending of the blood glucose level measurement sensor 6, was produced, or that the blood glucose level measurement sensor 6 fell out from the packaging pouch and dropped. Similar phenomena were observed for all five samples, and those for which such results were observed are shown by the "Δ" symbol in Table 1.

Next, in the case in which the angle 7 of contact of the direction in which tearing advances 9 and the blood glucose level measurement sensor 6 was 80°, the tear line inevitably contacted the blood glucose level measurement sensor 6 upon reaching the vicinity of contact with the blood glucose level measurement sensor 6. At this time, there was some perceptible stress, but the tear line began to diverge into two in a relatively smooth manner, and it was possible for tearing to proceed until the end section of the blood glucose level measurement sensor 6 (blood glucose level measurement sensor) was completely exposed.

However, in one of the samples, when the tear line reached the vicinity of contact with the blood glucose level measurement sensor 6, it was obstructed by the blood glucose level measurement sensor 6 in the same manner as in the 85° orientation discussed above, making it difficult for tearing to proceed. Moreover, greater force was needed in order to induce the tear line to diverge in two.

At this time, the phenomena of damage such as bending of the blood glucose level measurement sensor 6, or of the blood glucose level measurement sensor 6 falling out and dropping from the packaging pouch, were not produced, but greater force was needed in order to induce the tear line to diverge in two. Accordingly, in Table 1, this one sample is denoted by the "Δ" symbol, while the other four samples are denoted by the "○" symbol, as it was possible to open them relatively smoothly.

Next, in the case in which the angle 7 of contact of the direction in which tearing advances 9 and the blood glucose level measurement sensor 6 was 65°, the tear line contacted the blood glucose level measurement sensor 6 upon reaching the vicinity of contact with the blood glucose level measurement sensor 6. At this time, there was no perceptible stress whatsoever, the tear line began to diverge into two in a very smooth manner, and it was possible for tearing to proceed until the end section of the blood glucose level measurement sensor 6 was completely exposed.

Even when split apart more vigorously through greater force, the phenomena of damage such as bending of the blood glucose level measurement sensor 6, or of the content falling out and dropping from the packaging pouch, were not produced, and good results such that the conventional problems were completely overcome were obtained. Similar phenomena were observed for all five samples, and accordingly these good results are shown by the "◎" symbol in Table 1.

Next, in the case in which the angle 7 of contact of the direction in which tearing advances 9 and the blood glucose level measurement sensor 6 was 45°, the results were similar to those observed with 65° as discussed previously. Accordingly, these are denoted by the "◎" symbol in Table 1.

Next, in the case in which the angle 7 of contact of the direction in which tearing advances 9 and the blood glucose level measurement sensor 6 was 25°, the results were similar to those observed with 65° and 45° as discussed previously. Accordingly, these are denoted by the "◎" symbol in Table 1.

Next, in the case in which the angle 7 of contact of the direction in which tearing advances 9 and the blood glucose level measurement sensor 6 was 10°, as the tear line reached the vicinity of contact with the blood glucose level measurement sensor 6, it contacted the blood glucose level measurement sensor 6 at a site closer than the end section **6*a* (see FIG. 2). At this time, the tear line began to diverge very smoothly in two directions, and it was possible for tearing to proceed until the end section of the blood glucose level measurement sensor 6** was exposed.

Even when split apart more vigorously through greater force, the phenomena of damage such as bending of the blood glucose level measurement sensor 6, or of the blood glucose level measurement sensor 6 falling out and dropping from the packaging pouch, were not produced. However, because the tear line contacted the blood glucose level measurement sensor 6 at a site closer than the end section **6*a*, the area of the end section of the blood glucose level measurement sensor 6 exposed from the packaging pouch after opening tended to be smaller. In three of the samples, while the exposed area of the end section tended to be smaller, there was no noticeable difficulty in taking out it, and the problem never rose to a level that would pose a problem in using the blood glucose sensor. Accordingly, these are denoted by the "○" symbol in Table 1. With the other two samples, the exposed area of the end section of the blood glucose level measurement sensor 6** was reduced to the point that there was noticeable difficulty in taking out, and therefore these are denoted by the "Δ" symbol in Table 1.

Next, in the case in which the angle 7 of contact of the direction in which tearing advances 9 and the blood glucose level measurement sensor 6 was 5°, the tear line contacted a site even closer to the end section of the blood glucose level measurement sensor 6 than that observed with 10° as discussed previously. For this reason, the area of the end section of the blood glucose level measurement sensor 6 exposed from the packaging pouch after opening was markedly smaller. Moreover, due to the fact that the tear line did not adequately diverge in two directions, with all five samples, there was minimal exposure of the end section of the blood glucose level measurement sensor 6, and there was noticeable difficulty in taking out. Accordingly, these are denoted by the "Δ" symbol in Table 1.

Next, in the case in which the angle 7 of contact of the direction in which tearing advances 9 and the blood glucose level measurement sensor 6 was 0°, even when the tear line reached the vicinity of the blood glucose level measurement sensor 6, opening ceased before there was contact between the tear line and the blood glucose level measurement sensor 6. For this reason, the end section of the content, i.e., the blood glucose level measurement sensor 6, failed to be exposed from the packaging pouch at all, making it difficult to take out the blood glucose level measurement sensor 6.

In case in which the tear line and the blood glucose level measurement sensor 6 just barely come into contact, the tear line, and the blood glucose level measurement sensor 6 at a short side thereof, come into contact at a contact angle of 90°. For this reason, in like manner to the case of the 90° arrangement discussed above, the tear line is obstructed by the blood glucose level measurement sensor 6 and comes to a stop there, so that tearing does not proceed, making opening difficult.

In such cases, it was necessary to intentionally shift the blood glucose level measurement sensor to make fine adjustments to the direction in which tearing advances, in order to induce the tear line to diverge into two directions. Furthermore, when even greater force was exerted during opening to pull apart the pouch vigorously, the tear line sometimes contacted the blood glucose level measurement sensor 6, producing damage such as bending of the blood glucose level measurement sensor 6, or causing the blood glucose level measurement sensor 6 to fall out and drop from the packaging pouch, or producing other such problems, so that good results were not obtained. Similar phenomena were observed for all five samples, and those with undesirable results are shown by the "x" symbol in Table 1.

As shown in Table 1, from the above results, it may be ascertained that the angle 7 of contact of the blood glucose level measurement sensor 6 and the direction in which tearing advances 9 from the notch 4 or from the design pattern indicating a tear start point is preferably arranged at an angle of 5° to 85°. In tests of ease of opening, it was found that an angle of 10° to 80° is preferable, with 25° to 65° being even more preferable.

In the present embodiment, there has been devised an arrangement such that the blood glucose level measurement sensor 6 and the tear line come into contact on the diagonal, so as to make it possible for the opening operation subsequent to Step S104 in FIG. 17 for opening the aforementioned easy-open packaging pouch to be performed without stress.

Figure 23:
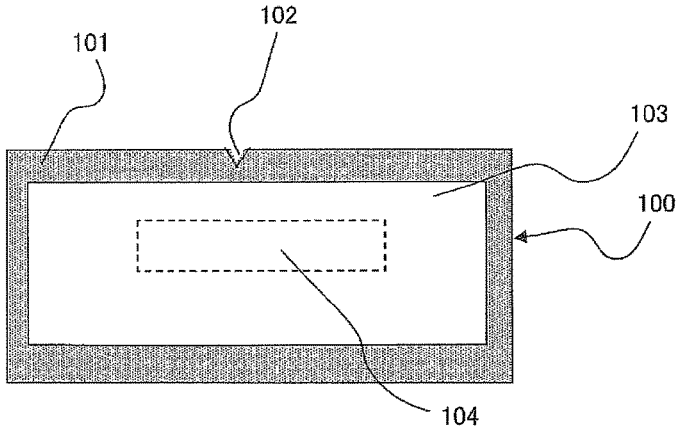
FIG. 23 is a plan view showing a conventional easy-open packaging pouch when opened.
Figure 24:
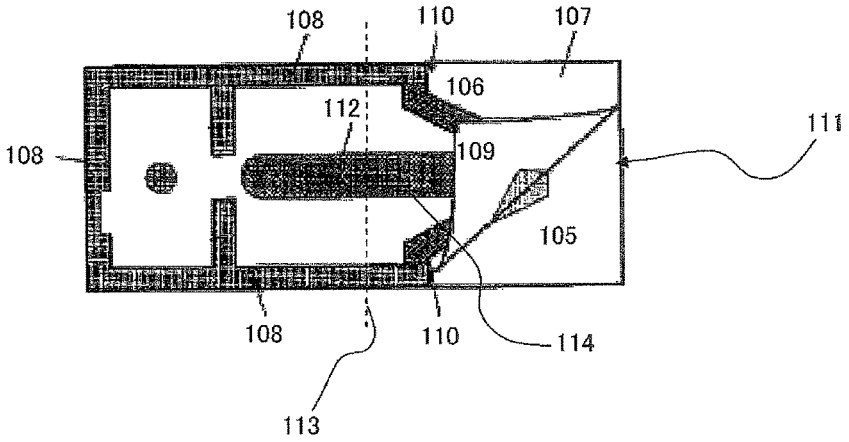
FIG. 24 is a plan view showing a conventional easy-open packaging pouch when opened.

In so doing, the two packaging films can easily be induced to begin to diverge in two respectively different directions when the tear line has contacted the blood glucose level measurement sensor 6. As a result, the blood glucose level measurement sensor 6 can be exposed, exclusively at the end section thereof, from the easy-open packaging pouch, without causing any damage to the blood glucose level measurement sensor 6, In this way, according to the easy-open packaging pouch of the present embodiment, the tearing operation subsequent to Step S104 can be completed without stress. For this reason, it will be appreciated that the issue originally encountered in the conventional technology shown in FIG. 23 (Precision Xtra G3b electrode (made by Abbott Laboratories)), i.e., the problem of the tear seam snagging on the blood glucose level measurement sensor 6 due to coming into contact with the blood glucose level measurement sensor 6 on the perpendicular when the tear seam reaches the vicinity of the blood glucose level measurement sensor 6, thus making it difficult for tearing to proceed, and/or, in cases of further application of opening force, the inconvenience associated with the blood glucose level measurement sensor 6 dropping, causing damage to the blood glucose level measurement sensor 6, have been reliably solved.

Moreover, according to the present embodiment, by adopting a packaging pouch designed to open by being pulled part from an origination point at a pre-provided notch or design pattern indicating a tear start point, the need for vigorous force for opening and closing, as in the configuration disclosed in Japanese Laid-Open Patent Application 11-278501, is obviated. The pouch is therefore easily opened by the elderly or other individuals who have frequent occasion to use the blood glucose level measurement sensor 6. Even when force is applied in a vigorous tearing operation, because only the end section of the blood glucose level measurement sensor 6 is exposed, the blood glucose level measurement sensor 6 will not drop out from the easy-open packaging pouch. Consequently, the first embodiment affords the advantageous effect of easy opening, such that contents are neither damaged nor fall out.

While there are no particular limitations as to the size of the easy-open packaging pouch, in cases in which, for example, the content is the blood glucose level measurement sensor 6 of tabular shape like that employed in the present tests, the size of the content is an overall length of approximately 29.5 mm, width of approximately 6.6 mm, and thickness of approximately 0.428 mm Accordingly, the size of the easy-open packaging pouch will be sufficient to accommodate the blood glucose level measurement sensor 6 constituting the contents thereof; the ones tested had overall length of approximately 70 mm, width of approximately 30 mm, and thickness of approximately 0.2 mm (Second Embodiment)

Another embodiment of the easy-open packaging pouch of the present invention shall be described below with reference to the drawings.

Elements that are equivalent to those in the afore described first embodiment are denoted by like reference symbols, and are treated as being included in the second embodiment as well. As the method for opening the easy-open packaging pouch is basically equivalent to that in the first embodiment, descriptions of identical aspects shall be omitted here.

Figure 3:
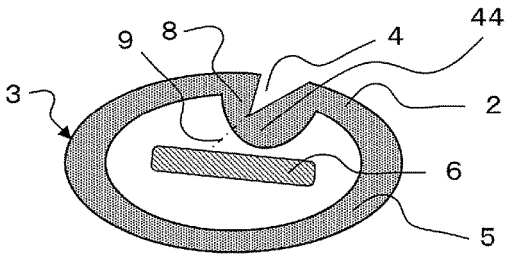
FIG. 3 is a cross sectional plan view showing the easy-open packaging pouch of the present invention prior to opening.

FIG. 3 is a cross sectional plan view showing the easy-open packaging pouch of the present embodiment prior to opening, which is an improved version of that in FIGS. 1 and 2 shown in the preceding first embodiment. FIG. 3 is a cross sectional view of the easy-open packaging pouch taken at the same location as E-E shown in FIG. 1B.

An aspect different from the preceding first embodiment is the shape of the bonded peripheral edge section in the vicinity of the notch. The easy-open packaging pouch of the present embodiment provided with a protruding section 44 formed by protruding the area of the bonded peripheral edge section 5 where the notch is formed towards the direction of the blood glucose level measurement sensor 6.

In a configuration as in FIGS. 1 and 2, when opening the easy-open packaging pouch, the opening operation advances in steps such that the tear line begins to tear from the notch 4 as the origination point (S101), advances on the diagonal towards the contents (S102), and reaches the blood glucose level measurement sensor 6 (S103) then advances to the opening operation, starting from the step in which the tear line. However, it is conceivable that in some cases, due to an increase or decrease of force applied by the fingertips or the like, midway through advance on the diagonal towards the contents (S102), the tear line may inflect towards a direction such that the tear line originating at the notch 4 will not contact the content 6.

In such a case, the tear line does not diverge in two as in S104 in FIG. 17 and FIG. 18C, and as a result, the end section 6*a* of the content, i.e., the blood glucose level measurement sensor 6 (see FIG. 2) is not exposed from the packaging pouch. Consequently, it is difficult to taking out the content (the blood glucose level measurement sensor 6).

With the easy-open packaging pouch of the present embodiment, on the other hand, as shown in FIG. 3, designing the region of the bonded peripheral edge section 5 in which the notch 4 is formed to protrude in the direction of the blood glucose level measurement sensor 6 creates a shorter distance between the blood glucose level measurement sensor 6 and the bonded peripheral edge section 8 in which the notch 4 is formed. In so doing, the degree of freedom of the direction in which tearing advances 9 is reduced, making it possible to limit the direction in which tearing advances 9 to a fixed direction. As a result, there is increased frequency of contact of the direction in which tearing advances 9 and the blood glucose level measurement sensor 6, and the tear line diverges in two (S104), leading to smooth opening.

Table 2 represents the extent which affects contact frequency of the tear line and the blood glucose level measurement sensor 6 during opening, when the distance between the content wrapped in the easy-open packaging pouch and the area of the bonded peripheral edge section 5 in which the notch 4 is formed is varied.

TABLE 2

Opening performance check test
(Effect of distance between contents and area of bonded peripheral edge section where notch is formed)

| Distance | Result 1 | Result 2 | Result 3 | Result 4 | Result 5 | Evaluation |
|---|---|---|---|---|---|---|
| 5 mm | ○ | ○ | ○ | ○ | ○ | ○ |
| 10 mm | ○ | ○ | ○ | ○ | ○ | ○ |
| 15 mm | ○ | X | ○ | ○ | ○ | X |

In specific terms, as samples, a total of 15 easy-open packaging pouches, namely, five each of pouches in which the distance between the blood glucose level measurement sensor 6 and the area of the bonded peripheral edge section 5 where the notch 4 is formed, was adjusted within a range of 5 mm and 15 mm, specifically, to 5 mm, 10 mm and 15 mm, were prepared, and were opened in turn using the fingertips.

In the case in which the distance between the blood glucose level measurement sensor 6 and the area of the bonded peripheral edge section 5 where the notch 4 is formed was 5 mm, for all five samples, the tear line and the blood glucose level measurement sensor 6 came into contact, and the tear line smoothly diverged in two directions. Accordingly, in Table 2, these desirable results are denoted by the "○" symbol.

In the case in which the distance between the blood glucose level measurement sensor 6 and the area of the bonded peripheral edge section 5 where the notch 4 is formed was 10 mm, for all five samples, the tear line and the blood glucose level measurement sensor 6 came into contact, and the tear line smoothly diverged in two directions. Accordingly, in Table 2, these desirable results are denoted by the "○" symbol.

In the case in which the distance between the blood glucose level measurement sensor 6 and the area of the bonded peripheral edge section 5 where the notch 4 is formed was 15 mm, in one sample, the tear line inflected and did not contact the blood glucose level measurement sensor 6, nor was the tear line able to smoothly diverge in two directions. Accordingly, in Table 2, this undesirable result is denoted by the "x" symbol. In the other four samples, the tear line and the blood glucose level measurement sensor 6 came into contact, and the tear line diverged in two directions relatively smoothly. Accordingly, in Table 2, these results are denoted by the "o" symbol.

As shown in Table 2, the shorter the distance is between the blood glucose level measurement sensor 6 and the area of the bonded peripheral edge section 5 where the notch 4 is formed, the more the direction in which tearing advances 9 is limited to a fixed direction, increasing the frequency of contact of the tear line and the content (the blood glucose level measurement sensor 6). Consequently, it is preferable for the area of the bonded peripheral edge section 5 where the notch 4 is formed to protrude in the direction of the blood glucose level measurement sensor 6 where possible.

FIG. 4A to FIG. 4F are plan views showing shapes of the notch 4 provided to the easy-open packaging pouch of the present embodiment. FIG. 4A to FIG. 4F show shapes of notches provided in end sections of packaging pouches constructed by opposing the heat-bondable resin layers of two synthetic resin films having a heat-bondable resin layer on at least one surface thereof, and heat bonding the films at their peripheral edge. The shape thereof can be a simple cutout shape, or a shape that narrows at the distal end towards the direction in which tearing advances from the notch, and may be devised as appropriate to have a "V" shape, a "U" shape, a "home plate" shape, an "I" shape, or the like, for easy opening.

For example, the notches 50, 51 shown in FIG. 4A and FIG. 4B are V" shaped, the notch 52 shown in FIG. 4C is lightning bolt-shaped, and the notch 53 shown in FIG. 4D is "home plate" shaped. The notch 54 shown in FIG. 4E is parallelogram shaped, and the notch 55 shown in FIG. 4F is heart shaped.

Figure 4:
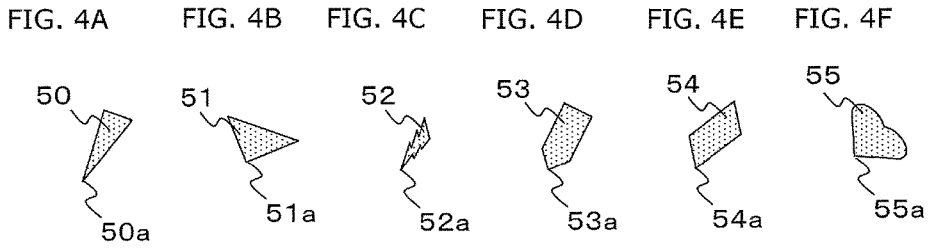
FIG. 4A to FIG. 4F are plan views showing the shape of notches disposed in the easy-open packaging pouch of the present invention.

In cases in which, conversely, the distal end is thicker, there is no problem as long as the structure is one affording easy opening. The dimensions of the notch are such as to constitute an incision 2 mm or more in length with respect to the transverse direction of the tear line, and whereas films for packaging purposes are tough, once a cut has been made, the cut tends to propagate easily. Therefore, when a cut is provided in advance at one or more sites in an end edge section, the pouch can be opened simply by the strength of the fingers, by pulling apart at this tear mouth. In FIG. 4, the start location of the tear line is the distal end of the downward-facing notch 4. In the notches 50, 51, 52, 53, 54, 55 in FIG. 4A to FIG. 4F, the tear line start locations are indicated respectively by 50*a*, 51*a*, 52*a*, 53*a*, 54*a*, and 55*a*.

Figure 5A:
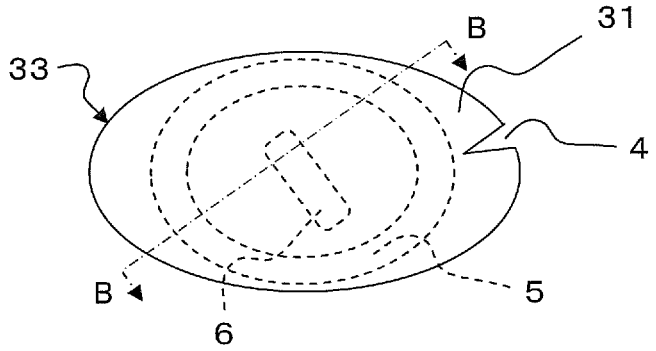
FIG. 5A is a plan view showing the easy-open packaging pouch of the present invention when opened.
Figure 5B:
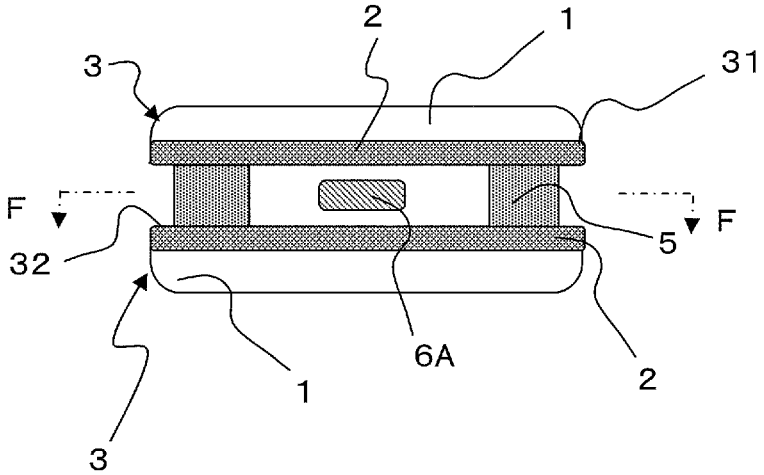
FIG. 5B is a cross sectional side view showing the easy-open packaging pouch of the present invention prior to opening.
Figure 5C:
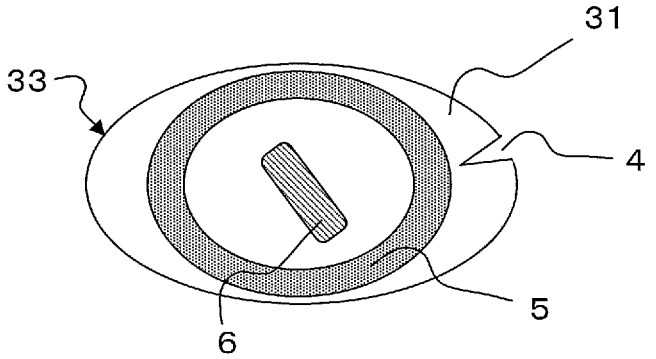
FIG. 5C is a cross sectional plan view showing the easy-open packaging pouch of the present invention prior to opening.

FIG. 5A, FIG. 5B and FIG. 5C show arrangements for the notch 4 and the bonded peripheral edge section 5 in easy-open packaging pouches produced by superimposing at least two packaging films 3, and forming the bonded peripheral edge section 5, and respectively show the state prior to opening, in plan view, cross sectional side view, and cross sectional plan view. FIG. 5B shows an enlarged section of the cross section at the location of line B-B shown in FIG. 5A. FIG. 5C is a view showing a cross section of the easy-open packaging pouch at the location of line F-F in shown FIG. 5B.

Here, the bonded peripheral edge section 5 has been formed to the inside of an outermost edge section 31 of the packaging film 3 including the base material layer 1 and the bonding layer 2. The notch 4 has been formed in the outermost edge section 31 of the packaging film 3 including the base material layer 1 and the bonding layer 2.

By not forming the notch 4 in the bonded peripheral edge section 5 in this way, it is possible to ensure ample surface area of the bonded peripheral edge section 5. Therefore, the surface area of the bonded peripheral edge section 5 is not limited by the notch 4. Accordingly, an advantageous effect is that an easy-open packaging pouch having exceptional moisture resistance that better maintains a hermetic seal can be obtained.

Whereas films for packaging purposes are tough, once a cut has been made, the cut tends to propagate easily. Consequently, where a non-bonded section 32 is provided in a predetermined area at the peripheral edge of the bonded peripheral edge section 5, and the advantageous effect is that it may function for protective purposes, preventing a cut from being made directly in the bonded peripheral edge section 5.

Furthermore, the non-bonded section 32 constituted by a non-bonded section of the outermost edge section 31 of the packaging film 3 including the base material layer 1 and the bonding layer 2 can be utilized as a tab for grasping, thereby providing excellent ease of handling when opening, and simplifying the opening operation.

Figure 6A:
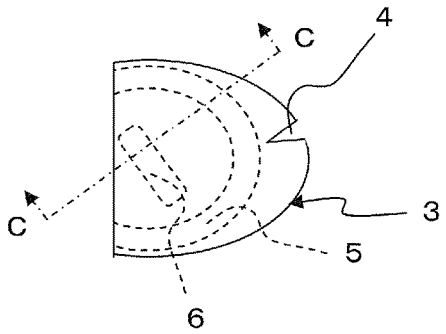
FIG. 6A is a plan view showing the easy-open packaging pouch of the present invention when opened.
Figure 6B:
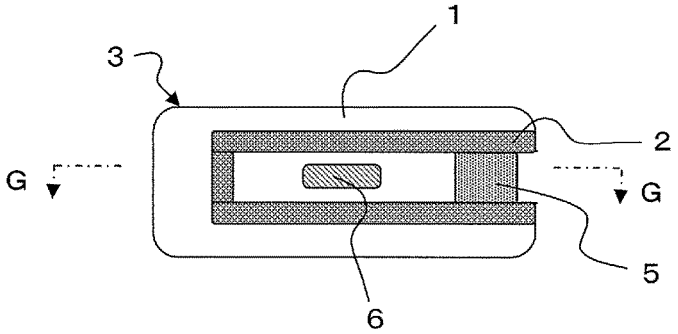
FIG. 6B is a cross sectional side view showing the easy-open packaging pouch of the present invention prior to opening.
Figure 6C:
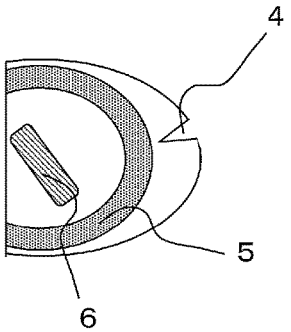
FIG. 6C is a cross sectional plan view showing the easy-open packaging pouch of the present invention prior to opening.

FIG. 6A, FIG. 6B, and FIG. 6C show examples of forms of the easy-open packaging pouch of the present embodiment.

A plan view, a cross sectional side view, and a cross sectional plan view showing packaging pouches in which the bonded peripheral edge section 5 has been formed along the peripheral edge except at one side formed by folding of at least one packaging film 3.

FIG. 6B shows an enlarged section of the cross section at the location of line C-C shown in FIG. 6A. FIG. 6C is a view showing a cross section of the easy-open packaging pouch at the location of line G-G in shown FIG. 6B.

In such a configuration, as no notch 4 is formed at the one folded side, propagation of the cut when a cut has been made at the notch 4 is not an issue. Furthermore, the fact that there is no need to apply an adhesive has the advantageous effect of minimizing process losses during production and the like.

Figure 7:
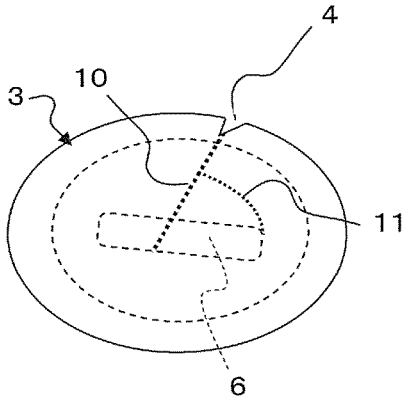
FIG. 7 is a plan view showing the easy-open packaging pouch of the present invention prior to opening.

FIG. 7 is a plan view showing the easy-open packaging pouch of the present embodiment prior to opening, and shows a rupture line 10 pre-provided in the packaging film, to the surface thereof on the opposite side from the bonding layer 2 of the packaging film 3.

Here, the following aspects differ from FIG. 2.

Specifically, the rupture line 10 leads the direction in which tearing advances 9 to the blood glucose level measurement sensor 6, from the distal end part of the notch 4, or from the design pattern indicating the tear start point. The contact angle 11 of the rupture line 10 and the blood glucose level measurement sensor 6 is preferably from 5° to 85°.

In so doing, it is possible for the direction in which tearing advances to be reliably led in a direction useful for the purposes of smooth opening. The preferred contact angle 11 of the rupture line 10 and the blood glucose level measurement sensor 6 is from 10° to 80°, and more preferably from 25° to 65°. Pre-providing the rupture line 10 to the surface of the packaging film 3 in this way has the advantageous effect that the contact angle 11 can be adjusted. In preferred practice, the rupture lines 10 are provided on both surfaces of the packaging films 3.

Figure 8A:
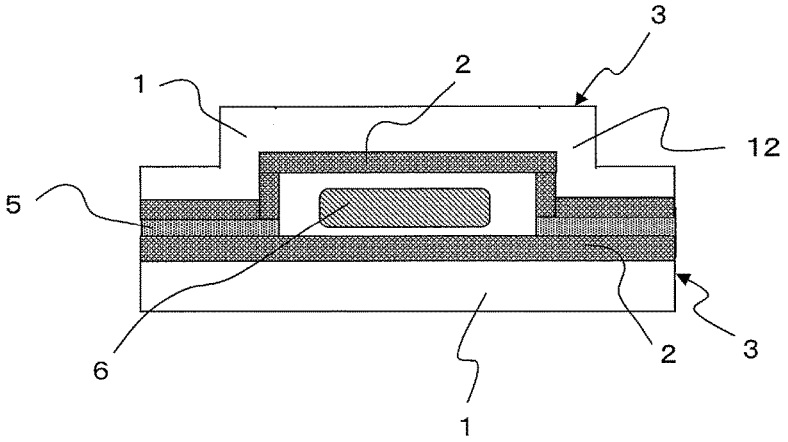
FIG. 8A is a cross sectional view showing the easy-open packaging pouch of the present invention prior to opening, when the area surrounding the contents in at least one of the packaging films has been deformed to a blister structure.
Figure 8B:
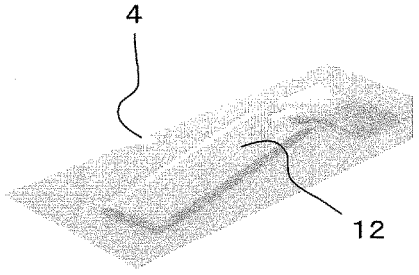
FIG. 8B is a perspective view showing the easy-open packaging pouch of the present invention prior to opening, when the area surrounding the contents in at least one of the packaging films has been deformed to a blister structure.

FIG. 8A and FIG. 8B are respectively a cross sectional side view and a perspective view showing the easy-open packaging pouch of the present invention prior to opening, and showing the area surrounding the blood glucose level measurement sensor 6, in at least one of the packaging films 3, having been deformed into a blister structure 12.

Here, the blister structure 12 refers to a shape in which the surface of the bonding layer 2 of the packaging film 3 has been deformed to concave shape, and the surface of the base material layer 1 to convex shape. According to the blister process, it is possible to modify the packaging film 3 to any desired shape, and therefore at least one of the packaging films 3 is deformed to a shape such that the blood glucose level measurement sensor 6 can be wrapped, and the blood glucose level measurement sensor 6 then wrapped therein at the location of this deformed blister structure 12.

In so doing, the blood glucose level measurement sensor 6 is secured in place, which has the advantageous effect that deviation of the contact angle 11 at which the tear line contacts the blood glucose level measurement sensor 6 can be minimized.

Moreover, because the blood glucose level measurement sensor 6 is secured in place within the blister structure 12, it can be retained in a stable fashion. Furthermore, through the blister structure 12 it is possible to adjust the angle 7 between the direction in which tearing advances 9 and the blood glucose level measurement sensor 6 (see FIG. 2) to an angle useful for the purposes of opening, as mentioned above.

In FIG. 8, the blister structure 12 is provided in only one side of the packaging film 3, but could be provided in both surfaces if needed.

Figure 9A:
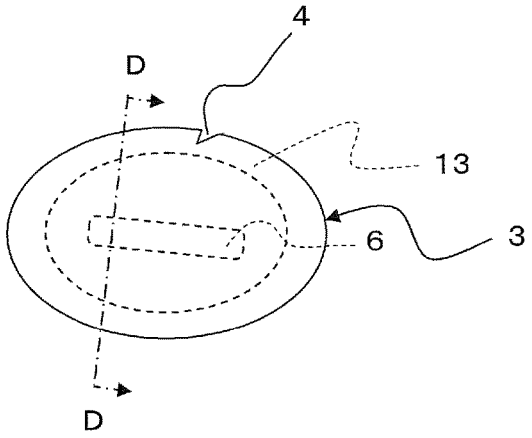
FIG. 9A is a plan view showing the easy-open packaging pouch of the present invention prior to opening.
Figure 9B:
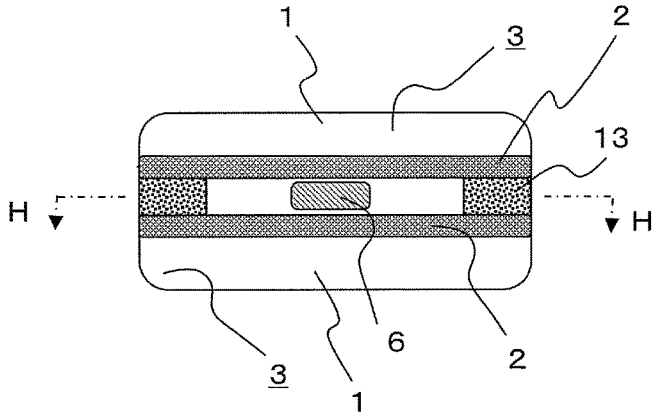
FIG. 9B is a cross sectional side view showing the easy-open packaging pouch of the present invention prior to opening.
Figure 9C:
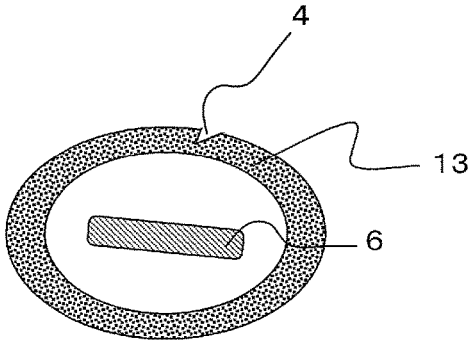
FIG. 9C is a cross sectional plan view showing the easy-open packaging pouch of the present invention prior to opening.

FIG. 9A, FIG. 9B, and FIG. 9C are respectively a plan view, a cross sectional side view, and a cross sectional plan view showing the easy-open packaging pouch of the present invention prior to opening, in which the bonded peripheral edge section of at least one of the packaging films 3 is a thermoplastic resin layer 13.

FIG. 9B shows an enlargement of a cross section taken at location D-D shown in FIG. 9A. FIG. 9C is a view showing a cross section of the easy-open packaging pouch taken at location H-H shown in FIG. 9B.

While the shape of the easy-open packaging pouch of the present embodiment is the same as in FIG. 2, the mode of bonding of the bonded peripheral edge section differs. In specific terms, in FIG. 9, isolation from outside air for complete hermetic sealing is accomplished simply by heat bonding for a short time, without the need for adhesives, which is exceptional not just from the aspect of maintainability of the content, but exceptional in terms of productivity as well, making possible faster takt times on the production line. Moreover, because adhesives are not employed, the content is not damaged by gases emitted by adhesives.

Figure 10A:
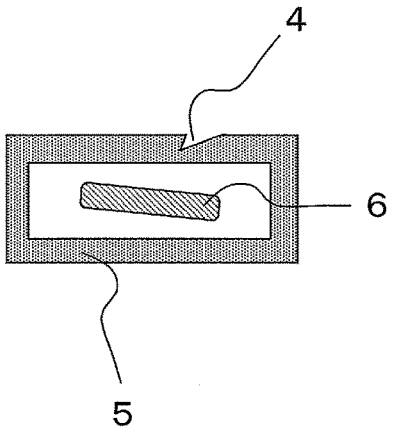
FIG. 10A to FIG. 10C are plan views showing the easy-open packaging pouch of the present invention prior to opening.
Figure 10B:
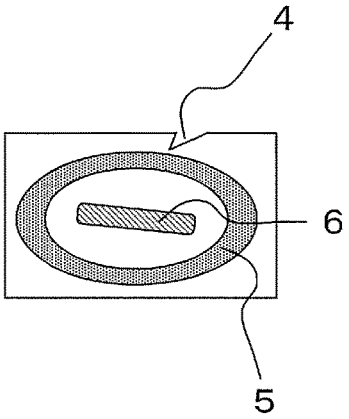
Figure 10C:
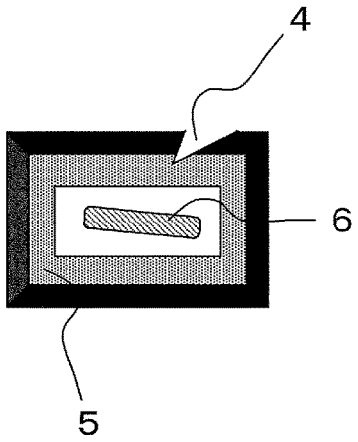

FIG. 10A, FIG. 10B, and FIG. 10C are cross sectional views showing the easy-open packaging pouch of the present invention prior to opening, in which at least either the packaging film 3 or the bonded peripheral edge section 5 is substantially tetragonal in shape. FIG. 10A shows the easy-open packaging pouch shown in FIG. 1, in which both the packaging film 3 and the bonded peripheral edge section 5 of the easy-open packaging pouch are formed to substantially tetragonal shape. FIG. 10B shows the easy-open packaging pouch shown in FIG. 5, in which the packaging film 3 of the easy-open packaging pouch is formed to substantially tetragonal shape, but the bonded peripheral edge section 5 is not formed to substantially tetragonal shape. FIG. 10C shows the easy-open packaging pouch shown in FIG. 5, in which the packaging film 3 of the easy-open packaging pouch is formed to substantially tetragonal shape, and the bonded peripheral edge section 5 is formed to substantially tetragonal shape as well. In the easy-open packaging pouch shown in FIG. 10B, the notch 4 does not reach the bonded peripheral edge section 5 in the same manner as in FIG. 5; however, in the easy-open packaging pouch shown in FIG. 10C, the notch 4 does reach the bonded peripheral edge section 5. In the easy-open packaging pouches shown in FIG. 10B and FIG. 10C, in order to prevent the tear line from advancing easily in the event that force is applied to the notch 4 from the outside, force from the outside can be cushioned by the section of packaging film 3 situated to the outside from the bonded peripheral edge section 5, thus minimizing advance of the tear line. In FIG. 10C, the section of packaging film 3 situated to the outside from the bonded peripheral edge section 5 has been modified to a darker color, making it easier to discern that the notch 4 reaches the bonded peripheral edge section 5.

Here, adopting a substantially tetragonal shape for the outside peripheral section has the advantageous effect that taking the content out is easier, in cases of taking it out of easy-open packaging pouches which are stored in stacked fashion, and the like.

Figure 11A:
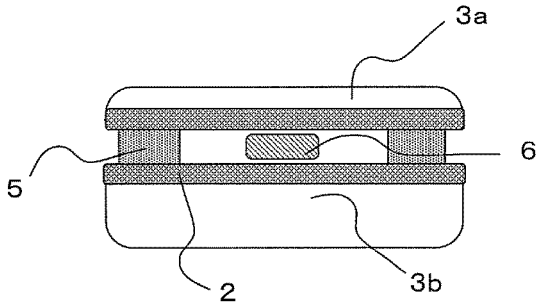
FIG. 11A is a cross sectional side view showing the easy-open packaging pouch of the present invention prior to opening.
Figure 11B:
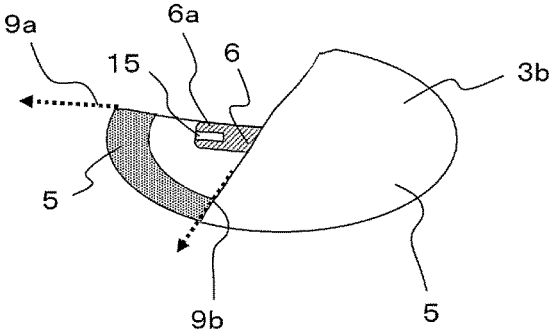
FIG. 11B is a plan view showing the easy-open packaging pouch of the present invention after opening.

FIG. 11A is a cross sectional side view showing the easy-open packaging pouch of the present invention prior to opening, in which, of the two packaging films 3, the thickness of one is thinner than the thickness of the other. FIG. 11B is a plan view showing the easy-open packaging pouch of the present invention when opened. FIG. 11B is a view seen from the film 3*b* side in FIG. 11.

Here, the packaging film 3*a* on the side at which the tear seam advances on an inflected path along the content is thinner than the packaging film 3*b* on the side at which the tear seam advances in unchanging fashion. A sample application section 15 of the content (the blood glucose level measurement sensor 6) is situated on the side facing towards the packaging film 3*b*, and therefore the sample application section 15 is exposed during opening.

If the thickness of one of the packaging films 3 is thinner, when the tear line reaches the vicinity of the blood glucose level measurement sensor 6 (S103), the packaging film 3 on the thin side tears more easily, and therefore the tear line easily diverges in two directions.

An even more preferred shape would be a shape in which the thickness of the packaging film on the side at which the tear seam advances on an inflected path along the contour line of the blood glucose level measurement sensor 6 (the side of direction in which tearing advances 9*a*) is thinner than the thickness of the packaging film on the side at which the tear seam advances in unchanging fashion (the side of direction in which tearing advances 9*b*). In so doing, the tear line (on the side of direction in which tearing advances 9*a* in FIG. 12) easily advances along the blood glucose level measurement sensor 6, making it possible to achieve even better ease of opening, and to reduce damage to the content.

Figure 12:
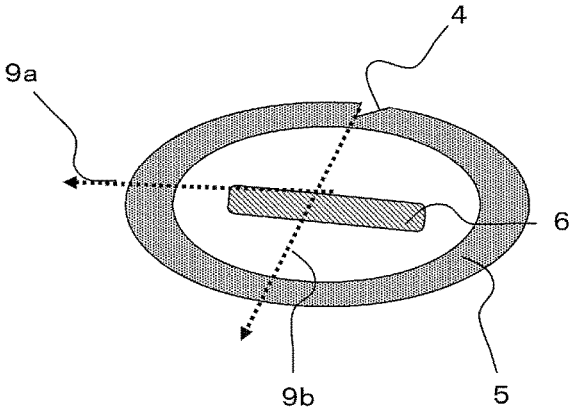
FIG. 12 is a cross sectional plan view showing the easy-open packaging pouch of the present invention prior to opening.

FIG. 12 is a cross sectional plan showing the easy-open packaging pouch of the present invention prior to opening.

Here, when the tear line from the distal end section of the notch 4 or a design pattern indicating the tear start point on the packaging film 3 contacts the blood glucose level measurement sensor 6 or reaches the vicinity thereof during opening, the tear line diverges in two. At this time, one of the tear lines advances in unchanging fashion along the direction in which tearing advances 9*b*, while the other tear line advances on an inflected path along the blood glucose level measurement sensor 6, along the direction in which tearing advances 9*a* (S 105).

FIG. 13A to FIG. 13D are cross sectional plan views showing the easy-open packaging pouch of the present invention prior to opening, and showing the location of the notch 4 or the design pattern indicating the tear start point. The notch 4 and the like shown in FIG. 13 is identical in configuration to that in FIGS. 7 and 12.

Figure 13A:
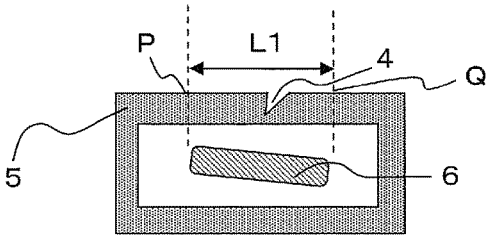
FIG. 13A to FIG. 13D are cross sectional plan views showing the easy-open packaging pouch of the present invention prior to opening.
Figure 13B:
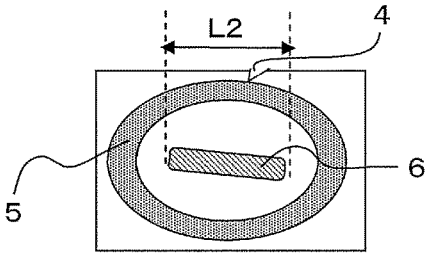
Figure 13C:
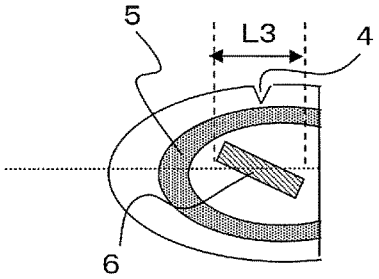
Figure 13D:
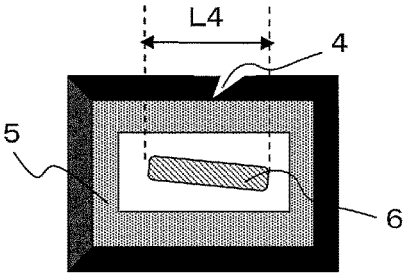

Here, the notch 4 is formed in an outside edge section of the packaging film, preferably between the top end and the bottom end of the sides of blood glucose level measurement sensor 6 in the lengthwise direction. The present shape increases the frequency of contact of the direction in which tearing advances 9 and the blood glucose level measurement sensor 6, leading to smooth opening in which the tear line diverges into two. In FIG. 13A there is disclosed an easy-open packaging pouch comparable to that in FIG. 10A, the distance between the top end and the bottom end of the sides in the lengthwise direction of the blood glucose level measurement sensor 6 being disclosed as L1. In FIG. 13B there is disclosed an easy-open packaging pouch comparable to that in FIG. 10B, the distance between the top end and the bottom end of the sides in the lengthwise direction of the blood glucose level measurement sensor 6 being disclosed as L2. In FIG. 13C there is disclosed an easy-open packaging pouch comparable to that in FIG. 6C, the distance between the top end and the bottom end of the sides in the lengthwise direction of the blood glucose level measurement sensor 6 being disclosed as L3. In FIG. 13D there is disclosed an easy-open packaging pouch comparable to that in FIG. 10C, the distance between the top end and the bottom end of the sides in the lengthwise direction of the blood glucose level measurement sensor 6 being disclosed as L4. It is preferable to provide the outside edge sections of the packaging films 3 with a notch or a design pattern indicating a tear start point at a location situated between two locations at which one end and the other end in the lengthwise direction of the blood glucose level measurement sensor 6 are projected out to the outside edge of the packaging film 3 (see P, Q in FIG. 13A), because this increases the frequency of contact between the direction in which tearing advances 9 and the blood glucose level measurement sensor 6.

Figure 20:
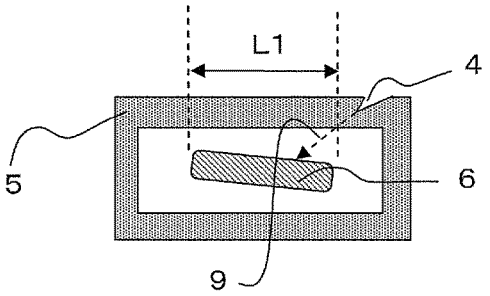
FIG. 20 is a cross sectional plan view showing the easy-open packaging pouch of the present invention prior to opening.

In preferred practice, the location of the notch 4 or of the design pattern indicating the tear start point will be at the center between the top end and the bottom end of the sides in the lengthwise direction of the blood glucose level measurement sensor 6. In cases in which the notch 4 or the design pattern indicating the tear start point is formed in the outside edge section of the packaging film, but provided in an area outside that between the top end and the bottom end of the sides in the lengthwise direction of the blood glucose level measurement sensor 6, it will be necessary to adopt a configuration wherein the orientation of the notch 4 or of the design pattern indicating the tear start point is controlled in such a way as to face towards the direction in which the blood glucose level measurement sensor 6 is arranged. Such a configuration for an easy-open packaging pouch is shown in cross sectional plan view in FIG. 20. In FIG. 20, the notch 4 is formed in a section outside of L1. The direction in which tearing advances 9 is shown as well. Even in cases such as this, because the direction in which tearing advances 9 is oriented towards the direction in which the blood glucose level measurement sensor 6 is arranged, and is moreover formed on the diagonal with respect to the blood glucose level measurement sensor 6, the tear line will diverge in two.

In FIG. 20, the perimeter of the packaging film 3 is depicted as being substantially tetragonal; however, this would apply to an easy-open packaging pouch having a perimeter of elliptical shape, as shown in FIG. 1, as well. That is, it is sufficient for the locational relationship to be one such that the blood glucose level measurement sensor is arranged on the diagonal with respect to the direction in which tearing advances.

FIG. 14 is a cross sectional plan view showing the easy-open packaging pouch of the present invention prior to opening, and shows the respective locational relationships of the lengthwise directions of the blood glucose level measurement sensor 6 and the packaging film 3

The angle 14 between the lengthwise direction of the blood glucose level measurement sensor 6 and the lengthwise direction of the packaging film 3 is preferably arranged at an angle of 5° to 85° with respect to the lengthwise direction of the packaging film 3. Through the present shape, when the tear line contacts the blood glucose level measurement sensor 6 or reaches the vicinity thereof during opening, the tear line is easily induced to diverge in two, making smooth opening possible.

An angle of 10° to 80° is more preferred, and an angle of 25° to 65° still more preferred. The contact angle can be adjusted appropriately, not just through the location of the notch 4 or of the design pattern indicating the tear start point, but also through the location at which the content is arranged.

FIG. 15A is a plan view of the easy-open packaging pouch of the present embodiment after opening, exposing the sample application section 15 side of the biosensor during opening from the distal end section of the notch 4 or from the design pattern indicating the tear start point. FIG. 15B is a plan view showing the internal configuration of FIG. 15A; for descriptive purposes, in FIG. 15B, the packaging film 3 on the side closer to the viewer from the blood glucose level measurement sensor 6 is omitted.

After completion of the tearing operation through the opening steps discussed above, the content, i.e., the blood glucose level measurement sensor 6, remains exposed at only the sample application section side thereof out of the easy-open packaging pouch, and does not fall out from the easy-open packaging pouch. Therefore, damage to the biosensor from the impact of a fall, contamination, or the like, which would render the product unusable, is avoided.

The typical procedure for using the blood glucose level measurement sensor 6 is to insert the end thereof on the opposite side from the sample application section 15 into a measuring meter (the measuring instrument 28). The biosensor can be taken out of the packaging pouch by grasping only the sample application section 15, and then, without being shifted between hands, inserted as-is into the measuring meter. A resultant advantage is ease of use even for elderly individuals suffering from impaired dexterity of the fingertips, and who have frequent occasion to use the blood glucose level measurement sensor 6.

In the above manner, once the tear line from the distal end section of the notch 4 or from the design pattern indicating the tear start point contacts the blood glucose level measurement sensor 6 or reaches the vicinity of the blood glucose level measurement sensor 6, the tear line distinctly diverges in two, with one of the tear lines advancing in unchanging fashion, while the other tear line advances on an inflected path along the blood glucose level measurement sensor 6.

Figure 16A:
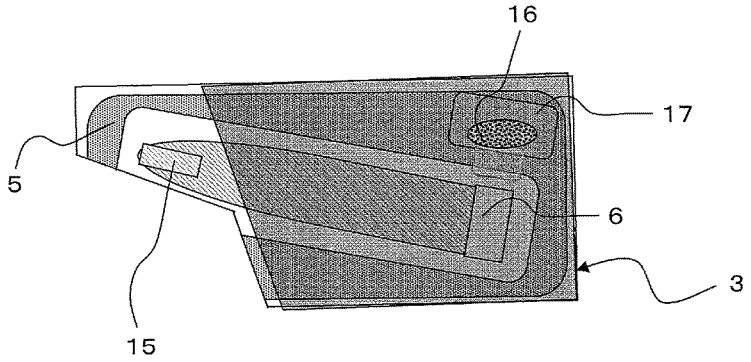
FIG. 16A is a plan view showing the easy-open packaging pouch of the present invention after opening.
Figure 16B:
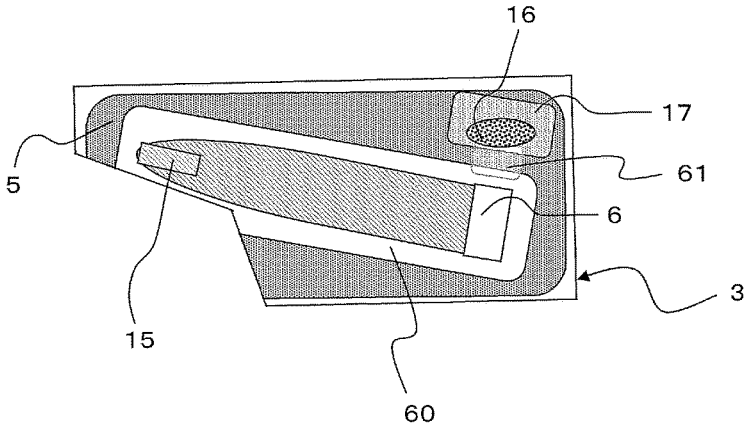
FIG. 16B is a plan view in which the packaging film on the closer side in FIG. 16A has been removed.

In FIG. 16A and FIG. 16B is disclosed an easy-open packaging pouch which somewhat improves upon the easy-open packaging pouch of FIG. 15. FIG. 16A is a plan view showing the easy-open packaging pouch after opening. FIG. 16B is a plan view showing the internal configuration of FIG. 16A; for descriptive purposes, in FIG. 16B, the packaging film 3 on the side closer to the viewer from the blood glucose level measurement sensor 6 is omitted.

With the easy-open packaging pouch shown in FIG. 16A and FIG. 16B, the easy-open packaging pouch of the present embodiment is provided with a desiccant retention area 17 for retaining a desiccant 16, for the purpose of maintaining a fixed humidity level in the area in which the biosensor is retained, and maintaining the performance of the biosensor for the warranty period.

Typically, the blood glucose level measurement sensor 6 is provided with a reagent section that is susceptible to humidity. It is therefore necessary to maintain humidity within the easy-open packaging pouch at a level such that the reagent section is unaffected.

In the present embodiment, the desiccant retention area 17 leads into a biosensor retaining section 60 via a connecting section 61, in order to control the humidity in the biosensor retaining section 60.

By providing the desiccant retention area 17 that retains the desiccant 16 in the space to the opposite side from the sample application section 15 which is exposed during opening, humidity generated inside the easy-open packaging pouch can be minimized. Furthermore, exposure or release of the desiccant 16 provided within the desiccant retention area 17 can be prevented during opening of the easy-open packaging pouch.

The desiccant retention area 17 may have the blister structure 12 shown in FIG. 10.

Test data similar to that in Table 1 described in the first embodiment was obtained for the various types of easy-open packaging pouch of the present second embodiment as well.

For the easy-open packaging pouches of the first and second embodiments of the present invention, the description focused on a manual opening method that primarily involves opening using the fingertips. However, it would be possible to instead utilize an automated opening method wherein opening is carried out separately, by an automated instrument or the like.

Figure 21A:
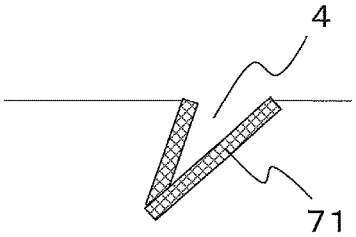
FIG. 21A to FIG. 21D are enlarged fragmentary views showing design patterns of the easy-open packaging pouch of the present invention.
Figure 21B:
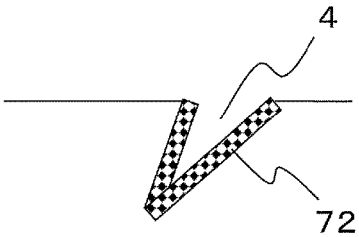
Figure 21C:
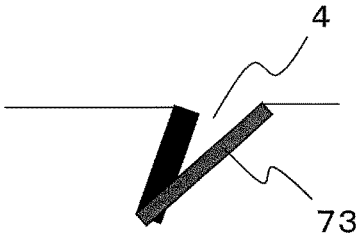
Figure 21D:
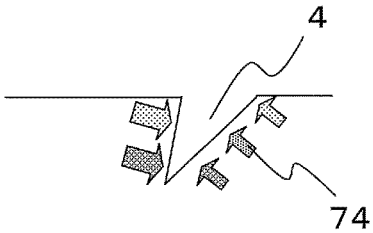

In the afore described embodiments, a notch was shown as the tear start point, but the tear start point may be more clearly indicated by a design pattern such as those shown in FIG. 21A to FIG. 21D. In FIG. 21A, there is formed a design pattern 71 of intersecting lines at the peripheral edges of the notch 4. In FIG. 21B, there is formed a design pattern 72 in which a plurality of tetragonal shapes are arranged at the peripheral edges of the notch 4. In FIG. 21C, there is formed a design pattern 73 in which color is applied at the peripheral edges of the notch 4. In FIG. 21D, there is formed a design pattern 74 in which a plurality of arrows are drawn pointing toward the notch 4, at the peripheral edges of the notch 4.

Figure 22:
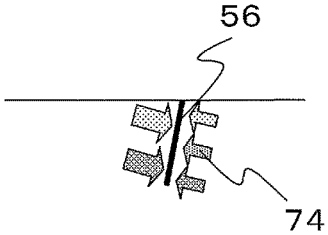
FIG. 22 is an enlarged fragmentary view showing a cut line and a design pattern of the easy-open packaging pouch of the present invention.

While the notches 4 in the preceding embodiments were formed by cutouts, these may be cut lines instead. In the case of cut lines, however, visibility is poor in some cases, and it is therefore preferable to provide a design pattern such as those in FIG. 21A to FIG. 21D, to indicate the tear start point. FIG. 22 shows a cut line 56 and the design pattern 74 provided at the peripheral edges thereof.

The design patterns are not limited to those shown herein, provided that the tear start point can be shown.

INDUSTRIAL APPLICABILITY

In the easy-open packaging pouch according to the present invention, when the tear line contacts the content or reaches the proximity thereof during opening, the tear line diverges in two, making possible opening without the tear line snagging on the content during opening, with advantageous effects such as avoiding damage (bending, scratches) to the content, preventing the content from falling out from the packaging pouch even when opened vigorously, and not requiring much force during opening, and therefore the packaging pouch is useful, for example, for content requiring care in handling (such as an electrode sensor for blood glucose level measurement or the like).

The invention claimed is:

1. An easy-open packaging pouch comprising:

a packaging film including a base material layer and a bonding layer;

a first side including the packaging film;

a second side including the packaging film;

a bonded peripheral edge section formed by superimposing the packaging film such that the bonding layer of the first side faces the bonding layer of the second side, and bonding at least a portion of the peripheral edges of the first side and the second side together;

a tear start point formed in the bonded peripheral edge section;

a content packaged in the easy-open packaging pouch;

wherein a linear edge portion of the content formed along the lengthwise direction of the content is arranged in a diagonal direction with respect to a direction in which tearing advances from the tear start point;

the first side further includes a first tear line configured to advance past the content without changing direction;

the second side further includes a second tear line configured to inflect along a contour line of the content; and the first tear line and the second tear line start at the tear start point.

2. The easy-open packaging pouch according to claim 1, wherein:

the tear start point is formed in an outside edge section of the packaging film beside the content, between a top end and a bottom end of the content.

3. The easy-open packaging pouch according to claim 1, wherein:

the content includes a biosensor configured to measure a sample component.

4. The easy-open packaging pouch according to claim 3, wherein:

the biosensor further includes a sample application section; and the biosensor is arranged on the packaging film such that the sample application section is exposed from opening the easy-open packaging pouch from the tear start point.

5. The easy-open packaging pouch according to claim 3, further comprising:

a drying area section disposed in the packaging film, and adapted to retain a desiccant, the desiccant configured to eliminate moisture from the biosensor.

6. The easy-open packaging pouch according to claim 1, wherein:

the tear start point includes a notch indicating the tear start point.

7. The easy-open packaging pouch according to claim 1, wherein:

the tear start point includes a design pattern indicating the tear start point.

8. The easy-open packaging pouch according to claim 1, wherein:

the content is arranged at an angle of 5° to 85° with respect to the direction in which tearing advances from the tear start point.

9. The easy-open packaging pouch according to claim 1, wherein:

the tear start point protrudes towards the content.

10. The easy-open packaging pouch according to claim 6, wherein:

the notch includes a cutout shape, or a shape that narrows in the direction in which tearing advances from the notch.

11. The easy-open packaging pouch according to claim 1, wherein:

the bonded peripheral edge section is formed in an outside edge section of the packaging film.

12. The easy-open packaging pouch according to claim 1, wherein:

at least a portion of the bonded peripheral edge section is formed extending inside from an outside edge section of the packaging film, and the tear start point is formed in an outside edge section of the packaging film.

13. The easy-open packaging pouch according to claim 1, wherein:

the bonded peripheral edge section is formed along all peripheral edges of the easy-open packaging pouch except for one side, the one side including a fold produced by folding a single piece of packaging film.

14. The easy-open packaging pouch according to claim 1, wherein:

the packaging film comprises at least two superimposed packaging films.

15. The easy-open packaging pouch according to claim 1, further including:

a rupture line formed on the packaging film configured to lead the direction in which tearing advances from the tear start point to the content during opening;

a contact angle formed between the rupture line and the content;

wherein the contact angle is within a range of 5° to 85°.

16. The easy-open packaging pouch according to claim 1, wherein:

an area surrounding the content in the packaging film has a blister structure.

17. The easy-open packaging pouch according to claim 1, wherein:

the bonded peripheral edge section includes a thermoplastic resin layer.

18. The easy-open packaging pouch according to claim 1, wherein:

at least one of the packaging film and the bonded peripheral edge section is substantially tetragonal in shape.

19. The easy-open packaging pouch according to claim 1, further including:

a second packaging film including a base material layer and a bonding layer;

wherein the second side includes the second packaging film instead of the first packaging film, and the second packaging film is thinner than the packaging film of the first side.

20. The easy-open packaging pouch according to claim 19, wherein:

the first side further includes a first tear line configured to advance past the content without changing direction;

the second side further includes a second tear line that inflects along a contour line of the content; and the first tear line and the second tear line start at the tear start point.

21. The easy-open packaging pouch according to claim 1, wherein:

the content is arranged at an angle of 5° to 85° with respect to a lengthwise direction of the packaging film.

* * * * *